US011685163B2

(12) United States Patent
Miyashita et al.

(10) Patent No.: US 11,685,163 B2
(45) Date of Patent: Jun. 27, 2023

(54) MEMBER INCLUDING PAD ELECTRODE, INK CARTRIDGE AND RECORDING APPARATUS

(71) Applicant: CANON KABUSHIKI KAISHA, Tokyo (JP)

(72) Inventors: Takeho Miyashita, Kanagawa (JP); Yasuo Kotaki, Kanagawa (JP); Tetsuya Ohashi, Chiba (JP); Ryoji Inoue, Kanagawa (JP); Takashi Fukushima, Kanagawa (JP); Hironori Murakami, Tokyo (JP); Kyosuke Nagaoka, Tokyo (JP); Kazuya Yoshii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 17/272,600

(22) PCT Filed: Sep. 26, 2019

(86) PCT No.: PCT/JP2019/039029
§ 371 (c)(1),
(2) Date: Mar. 1, 2021

(87) PCT Pub. No.: WO2020/067580
PCT Pub. Date: Apr. 2, 2020

(65) Prior Publication Data

US 2021/0370680 A1 Dec. 2, 2021

(30) Foreign Application Priority Data

Sep. 28, 2018 (JP) ..... 2018-184603

(51) Int. Cl.
*B41J 2/175* (2006.01)

(52) U.S. Cl.
CPC ..... *B41J 2/1753* (2013.01)

(58) Field of Classification Search
CPC ..... B41J 2/1753; B41J 2/175; B41J 2/17503; B41J 2/1752; B41J 2/17526
USPC ..... 347/86
See application file for complete search history.

(56) References Cited

U.S. PATENT DOCUMENTS

| | | | | |
|---|---|---|---|---|
| 5,425,478 | A | 6/1995 | Kotaki et al. | 222/501 |
| 5,430,471 | A | 7/1995 | Nakajima et al. | 347/87 |
| 5,567,373 | A | 10/1996 | Sato et al. | 264/112 |
| 5,583,549 | A | 12/1996 | Ujita et al. | 347/86 |

(Continued)

FOREIGN PATENT DOCUMENTS

| | | |
|---|---|---|
| CN | 105722684 | 6/2016 |
| EP | 1 080 916 | 3/2001 |

(Continued)

OTHER PUBLICATIONS

Office Action dated Jun. 28, 2022 in counterpart Japanese Application No. 2018-184603, together with English translation thereof.

(Continued)

*Primary Examiner* — Matthew Luu
*Assistant Examiner* — Alexander D Shenderov
(74) *Attorney, Agent, or Firm* — Venable LLP

(57) ABSTRACT

A member includes a plurality of pad electrodes and a casing, wherein the plurality of pad electrodes are mounted on the casing and are rotatable relative to the casing on the casing.

13 Claims, 19 Drawing Sheets

(56) References Cited

U.S. PATENT DOCUMENTS 5,589,862 A 12/1996 Ujita et al. ..... 347/87
5,608,437 A 3/1997 Iwata et al. ..... 347/86
5,619,237 A 4/1997 Inoue et al. ..... 347/86
5,619,239 A 4/1997 Kotaki et al. ..... 347/86
5,742,310 A 4/1998 Kotaki ..... 347/86
5,781,213 A 7/1998 Ujita et al. ..... 347/86
5,805,188 A 9/1998 Nakajima et al. ..... 347/87
5,815,184 A 9/1998 Ujita et al. ..... 347/87
5,852,457 A 12/1998 Kotaki et al. ..... 347/86
5,929,885 A 7/1999 Nakajima et al. ..... 347/87
5,988,804 A 11/1999 Kotaki et al. ..... 347/87
6,070,974 A 6/2000 Kotaki et al. ..... 347/86
6,116,722 A 9/2000 Sato et al. ..... 347/85
6,145,975 A 11/2000 Kotaki et al. ..... 347/87
6,170,939 B1 1/2001 Ujita et al. ..... 347/86
6,243,116 B1 6/2001 Kotaki et al. ..... 347/86
6,336,709 B1 1/2002 Inoue et al. ..... 347/49
6,338,546 B1 1/2002 Kotaki et al. ..... 347/49
6,361,158 B1 3/2002 Inoue et al. ..... 347/86
6,390,612 B1 5/2002 Kotaki et al. ..... 347/85
6,419,350 B1 7/2002 Abe et al. ..... 347/86
6,421,623 B1 7/2002 Furukawa et al. ..... 702/100
6,623,104 B1 9/2003 Kotaki et al. ..... 347/49
6,685,296 B2 2/2004 Mochizuki et al. ..... 347/19
6,719,394 B2 4/2004 Kubota et al. ..... 347/19
6,719,416 B2 4/2004 Anma et al. ..... 347/86
6,742,881 B2 6/2004 Kotaki et al. ..... 347/86
6,773,099 B2 8/2004 Inoue et al. ..... 347/86
6,827,411 B2 12/2004 Kubota et al. ..... 347/7
6,827,431 B2 12/2004 Kitabatake et al. ..... 347/86
6,830,324 B2 12/2004 Ogura et al. ..... 347/86
6,854,836 B2 2/2005 Ishinaga et al. ..... 347/85
6,869,158 B2 3/2005 Kojima et al. ..... 347/19
6,877,847 B2 4/2005 Hayashi et al. ..... 347/86
6,916,085 B2 7/2005 Kotaki et al. ..... 347/49
6,935,739 B2 8/2005 Inoue et al. ..... 347/104
6,942,326 B2 9/2005 Hayashi et al. ..... 347/86
6,959,984 B2 11/2005 Ogura et al. ..... 347/86
6,966,631 B2 11/2005 Matsuo et al. ..... 347/49
6,969,161 B2 11/2005 Kuwabara et al. ..... 347/85
6,976,753 B2 12/2005 Kuwabara et al. ..... 347/86
6,997,535 B2 2/2006 Mochizuki et al. ..... 347/19
6,997,548 B2 2/2006 Matsuo et al. ..... 347/86
7,004,575 B2 2/2006 Inoue et al. ..... 347/86
7,014,287 B2 3/2006 Kubota et al. ..... 347/7
7,077,514 B2 7/2006 Inoue et al. ..... 347/86
7,086,725 B2 8/2006 Ogura et al. ..... 347/86
7,104,640 B2 9/2006 Ogura et al. ..... 347/86
7,111,931 B2 9/2006 Amma et al. ..... 347/86
7,118,194 B2 10/2006 Matsuo et al. ..... 347/49
7,125,109 B2 10/2006 Watanabe et al. ..... 347/86
7,128,407 B2 10/2006 Inoue et al. ..... 347/85
7,134,747 B2 11/2006 Hayashi et al. ..... 347/86
7,165,829 B2 1/2007 Hayashi et al. ..... 347/49
7,192,111 B2 3/2007 Matsumoto et al. ..... 347/7
7,210,755 B2 5/2007 Kubota et al. ..... 347/7
7,290,861 B2 11/2007 Inoue et al. ..... 347/49
7,311,388 B2 12/2007 Ogura et al. ..... 347/87
7,350,910 B2 4/2008 Amma et al. ..... 347/86
7,360,876 B2 4/2008 Inoue et al. ..... 347/85
7,384,116 B2 6/2008 Kotaki et al. ..... 347/19
7,396,118 B2 7/2008 Ogawa et al. ..... 347/87
7,401,909 B2 7/2008 Inoue et al. ..... 347/86
7,407,274 B2 8/2008 Inoue et al. ..... 347/86
7,407,275 B2 8/2008 Inoue et al. ..... 347/86
7,517,067 B2 4/2009 Inoue et al. ..... 347/85
7,607,770 B2 10/2009 Inoue et al. ..... 347/85
7,726,792 B2 6/2010 Fukushima et al. ..... 347/86
7,735,984 B2 6/2010 Iijima et al. ..... 347/86
7,784,927 B2 8/2010 Inoue et al. ..... 347/86
7,914,137 B2 3/2011 Inoue et al. ..... 347/86
7,922,274 B2 4/2011 Kubota et al. ..... 347/7
7,926,927 B2 4/2011 Kotaki et al. ..... 347/86
7,950,790 B2 5/2011 Kubo et al. ..... 347/86
7,954,931 B2 6/2011 Shimizu et al. ..... 347/85
8,020,978 B2 9/2011 Ogawa et al. ..... 347/86
8,047,641 B2 11/2011 Nanjo et al. ..... 347/86
8,091,995 B2 1/2012 Shimizu et al. ..... 347/86
8,109,617 B2 2/2012 Kotaki et al. ..... 347/86
8,123,342 B2 2/2012 Ujita et al. ..... 347/86
8,136,930 B2 3/2012 Anma et al. ..... 347/86
8,141,998 B2 3/2012 Nozawa et al. ..... 347/86
8,205,974 B2 6/2012 Ogura et al. ..... 347/86
8,240,826 B2 8/2012 Fukushima et al. ..... 347/86
8,313,185 B2 11/2012 Hatasa et al. ..... 347/92
8,322,807 B2 12/2012 Seki et al. ..... 347/6
8,425,022 B2 4/2013 Inoue et al. ..... 347/86
8,469,498 B2 6/2013 Ohashi et al. ..... 347/86
8,529,037 B2 9/2013 Miyashita et al. ..... 347/86
8,550,607 B2 10/2013 Inoue et al. ..... 347/86
8,770,730 B2 7/2014 Nanjo et al. ..... 347/86
8,770,731 B2 7/2014 Miyashita et al. ..... 347/86
8,960,869 B2 2/2015 Takada et al. ..... 347/86
8,985,743 B2 3/2015 Sasaki ..... 347/49
9,016,842 B2 4/2015 Miyashita et al. ..... 347/86
9,278,540 B2 3/2016 Seki et al. ..... B41J 2/1752
9,333,758 B2 5/2016 Koshikawa et al. ... B41J 2/1752
9,375,938 B2 6/2016 Kondo et al. ..... B41J 2/17513
9,520,699 B2 12/2016 Urai et al. ..... H01H 31/003
9,597,884 B2 3/2017 Nanjo et al. ..... B41J 2/17526
9,597,888 B2 3/2017 Takahashi et al. ..... B41J 2/175
9,694,585 B2 7/2017 Shiba et al. ..... B41J 2/17513
9,724,929 B2 8/2017 Yoshii et al. ..... B41J 2/1752
9,821,562 B2 11/2017 Nanjo et al. ..... B41J 2/17523
9,840,082 B2 12/2017 Nanjo et al. ..... B41J 2/17513
9,908,338 B2 3/2018 Koshikawa et al. ..... B41J 29/02
9,914,305 B2 3/2018 Orihara et al. ..... B41J 2/17523
9,914,308 B2 3/2018 Yamada et al. ..... B41J 2/1404
9,919,536 B2 3/2018 Miyashita et al. ... B41J 2/17523
9,962,945 B2 5/2018 Takaoka et al. ..... B41J 2/17523
9,975,340 B2 5/2018 Karita et al. ..... B41J 2/14024
9,981,464 B2 5/2018 Karita et al. ..... B41J 2/155
9,981,477 B2 5/2018 Fukuchi et al. ..... B41J 2/17553
9,981,478 B2 5/2018 Ikebe et al. ..... B41J 29/02
10,005,287 B2 6/2018 Yamada et al. ..... B41J 2/14072
10,029,474 B2 7/2018 Takada et al. ..... B01D 19/0073
10,093,105 B2 10/2018 Shimamura et al. ..... B41J 2/17553
10,112,403 B2 10/2018 Ikebe et al. ..... B41J 2/1752
10,160,222 B2 12/2018 Shiba et al. ..... B41J 2/17566
10,195,868 B2 2/2019 Yamada et al. ..... B41J 2/175
10,207,511 B2 2/2019 Nanjo et al. ..... B41J 2/175
10,336,087 B2 7/2019 Miyashita et al. ... B41J 2/17509
10,391,776 B2 8/2019 Hayashi et al. ..... B41J 2/17513
10,399,346 B2 9/2019 Arai et al. ..... B41J 2/175
10,399,347 B2 9/2019 Miyashita et al. ... B41J 2/17506
10,427,412 B2 10/2019 Okude et al. ..... B41J 2/03
10,434,784 B2 10/2019 Hirata et al. ..... B41J 2/17596
10,471,711 B2 11/2019 Karita et al. ..... B41J 2/16585
10,538,092 B2 1/2020 Miyashita et al. ... B41J 2/17523
10,583,662 B2 3/2020 Yamada et al. ..... B41J 2/175
10,611,162 B2 4/2020 Ikebe et al. ..... B41J 2/17523
10,618,300 B2 4/2020 Shimamura et al. ..... B41J 2/17509
10,675,882 B2 6/2020 Shiba et al. ..... B41J 2/17566
10,792,930 B2 10/2020 Yamada et al. ..... B41J 2/165
10,836,175 B2 11/2020 Miyashita et al. ... B41J 2/17553
10,843,474 B2 11/2020 Arai et al. ..... B41J 29/13
10,906,323 B2 2/2021 Nagaoka et al. .... B41J 2/17553
2004/0246304 A1 12/2004 Takahashi et al. ..... 347/49
2005/0007420 A1 1/2005 Ogawa et al. ..... 347/50
2007/0220741 A1* 9/2007 Gieskes ..... H05K 13/041 29/739
2008/0018720 A1 1/2008 Fukushima et al. ..... 347/86
2008/0021170 A1 1/2008 Fukushima et al. ..... 525/340
2008/0106575 A1 5/2008 Shimizu et al. ..... 347/49
2008/0136878 A1 6/2008 Nozawa et al. ..... 347/86
2008/0284810 A1 11/2008 Shimizu et al. ..... 347/20
2011/0205284 A1 8/2011 Yoshino et al. ..... 347/20
2012/0114365 A1 5/2012 Kubo et al. ..... 399/90
2013/0050310 A1 2/2013 Seki et al. ..... 347/6
2014/0168324 A1 6/2014 Sasaki ..... 347/86
2015/0131207 A1 5/2015 Urai et al. ..... 361/618

(56) References Cited

U.S. PATENT DOCUMENTS

| | | | | |
|---|---|---|---|---|
| 2015/0340805 | A1* | 11/2015 | Jordan | H01R 13/622 439/338 |
| 2016/0200114 | A1 | 7/2016 | Nanjo et al. | 347/86 |
| 2017/0197426 | A1 | 7/2017 | Nagai et al. | B41J 2/1404 |
| 2018/0015728 | A1 | 1/2018 | Nanjo et al. | B41J 2/1752 |
| 2018/0093481 | A1 | 4/2018 | Hirata et al. | B41J 2/17543 |
| 2020/0198359 | A1 | 6/2020 | Shimamura et al. | B41J 2/17509 |
| 2020/0282729 | A1 | 9/2020 | Inoue et al. | B41J 2/175 |

FOREIGN PATENT DOCUMENTS

| | | |
|---|---|---|
| EP | 2 743 086 | 6/2014 |
| EP | 2950401 | 12/2015 |
| EP | 3 047 975 | 7/2016 |
| EP | 3 300 904 | 4/2018 |
| EP | 3 301 516 | 4/2018 |
| JP | 2008-273173 | 11/2008 |
| JP | 2014-117836 | 6/2014 |
| JP | 2018-052038 | 4/2018 |
| WO | 2013/157360 | 12/2015 |
| WO | 2015/041364 | 3/2017 |
| WO | 2020/067581 | 4/2020 |

OTHER PUBLICATIONS

Office Action dated Dec. 23, 2021 in counterpart Chinese Application No. 201980062246.2, together with English translation thereof.
Office Action dated Oct. 18, 2022 in counterpart Japanese Application No. 2018-184603, together with English translation thereof.
U.S. Appl. No. 17/272,588, filed Mar. 1, 2021.
International Search Report and Written Opinion in counterpart PCT/JP2019/039029.
EPC Communication dated Nov. 18, 2022 in counterpart EP Application No. 19795688.1.

* cited by examiner (a)

(b)

(a)

(b)

MEMBER INCLUDING PAD ELECTRODE, INK CARTRIDGE AND RECORDING APPARATUS

TECHNICAL FIELD

The present invention relates to a member including a pad electrode, an ink cartridge, and a recording apparatus capable of mounting the ink cartridge.

BACKGROUND ART

As a recording apparatus such as an inkjet printer and a laser beam printer, there is a recording apparatus to which a member (for example, an ink cartridge) including an electrode portion provided with a pad electrode can be mounted. When such a member is mounted on the recording apparatus, the pad electrode of the member is in a state in which it is electrically connected to the electric connection portion on the recording apparatus side.

Japanese Laid-open Patent Application No. 2008-273173 describes an ink cartridge provided with a circuit board (pad electrode) including a memory element. When this ink cartridge is mounted to the recording apparatus, the connection terminal of the recording apparatus and the pad electrode of the ink cartridge are brought into the electrical connection with each other.

SUMMARY OF THE INVENTION

Representative structures are as follows.

A member comprising a plurality of pad electrodes and a casing, wherein the plurality of pad electrodes are mounted to the casing and are rotatable relative to the casing on the casing.

Further features of the present description will be apparent from the following description of the example with reference to the attached drawings.

Figure 2:
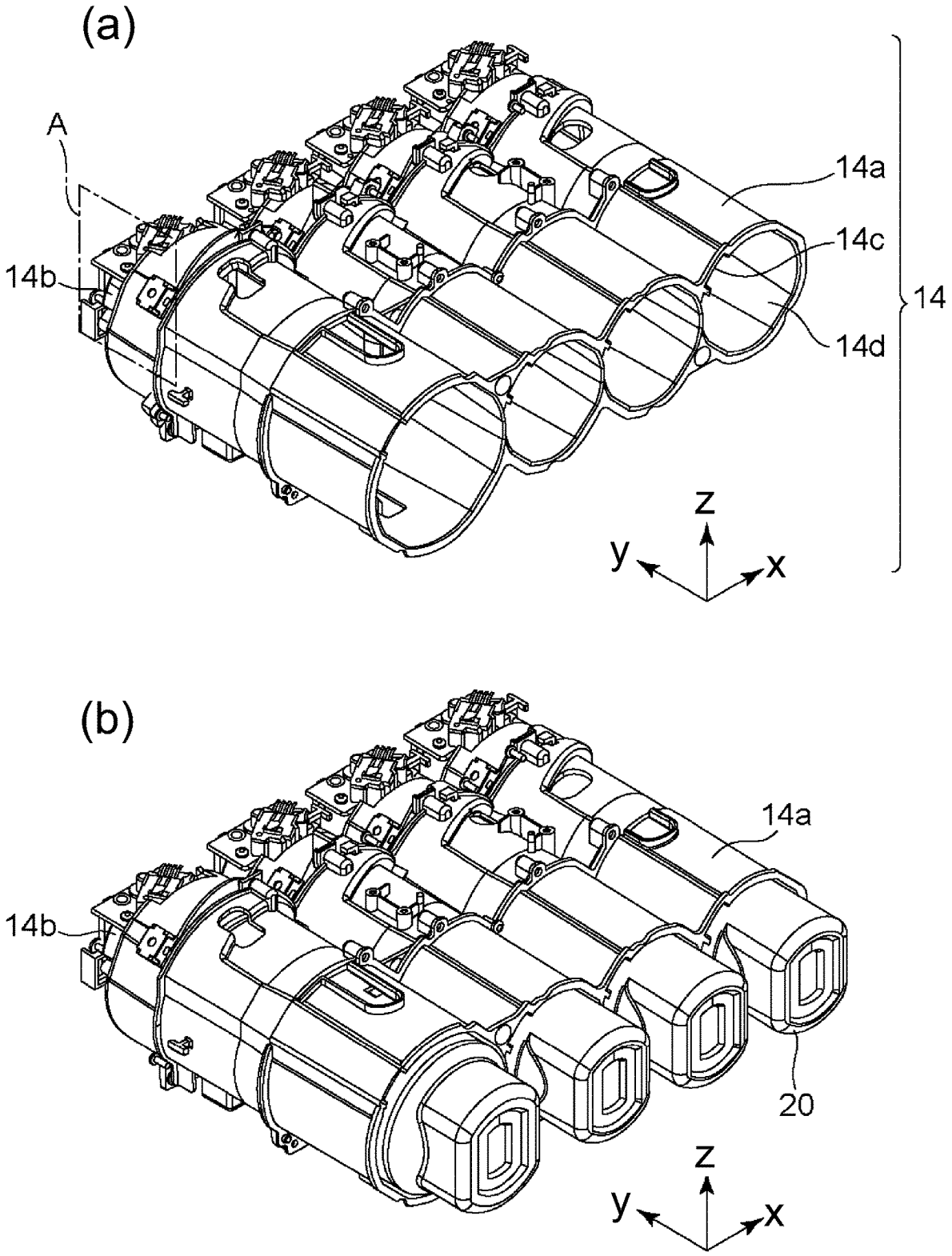

Parts (a) and (b) of FIG. 2 are perspective views illustrating a structure of a mounting portion.

Figure 3:
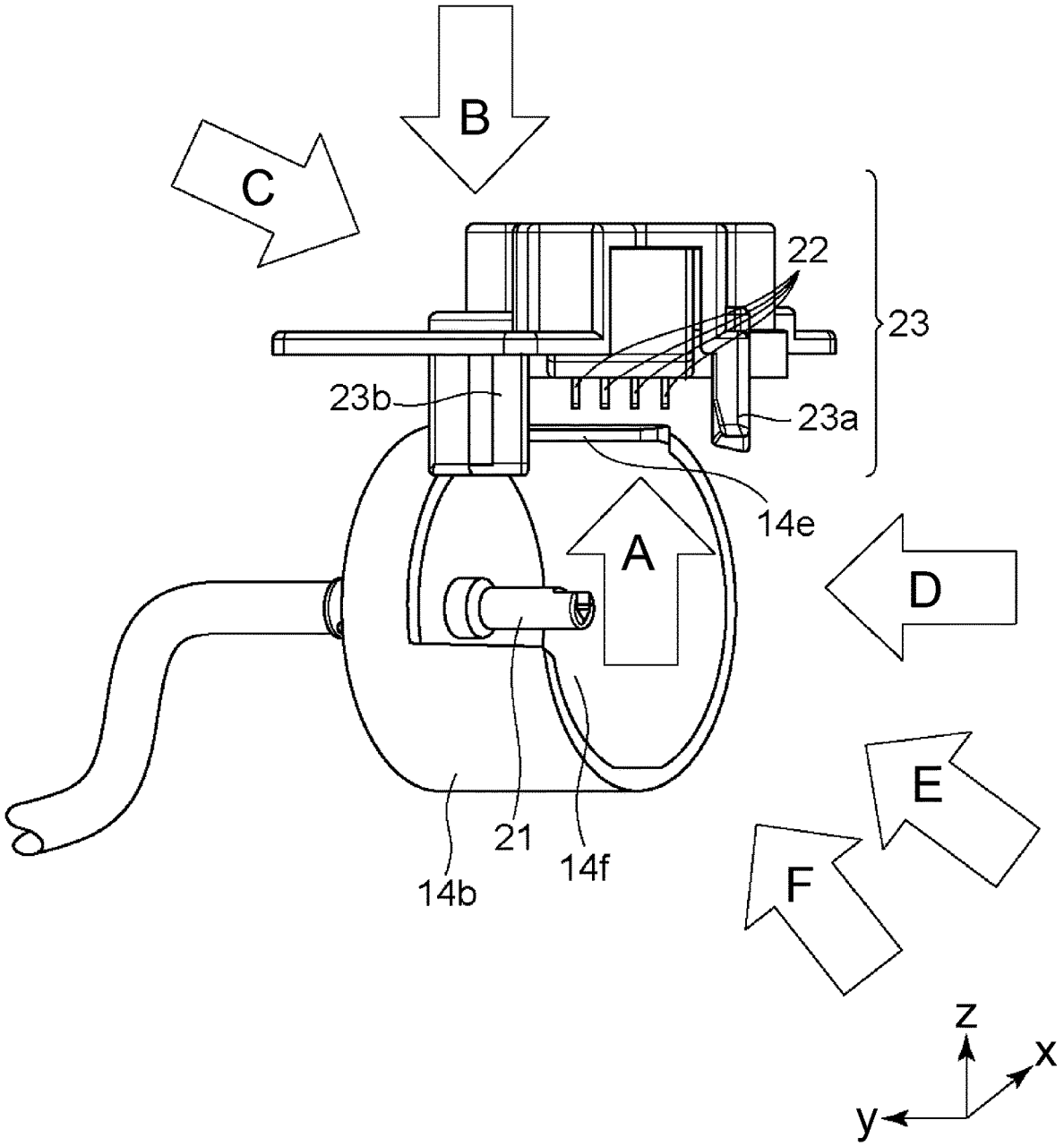

FIG. 3 is a perspective view illustrating the structure around the electrical connecting portion of the mounting portion.

Figure 4:
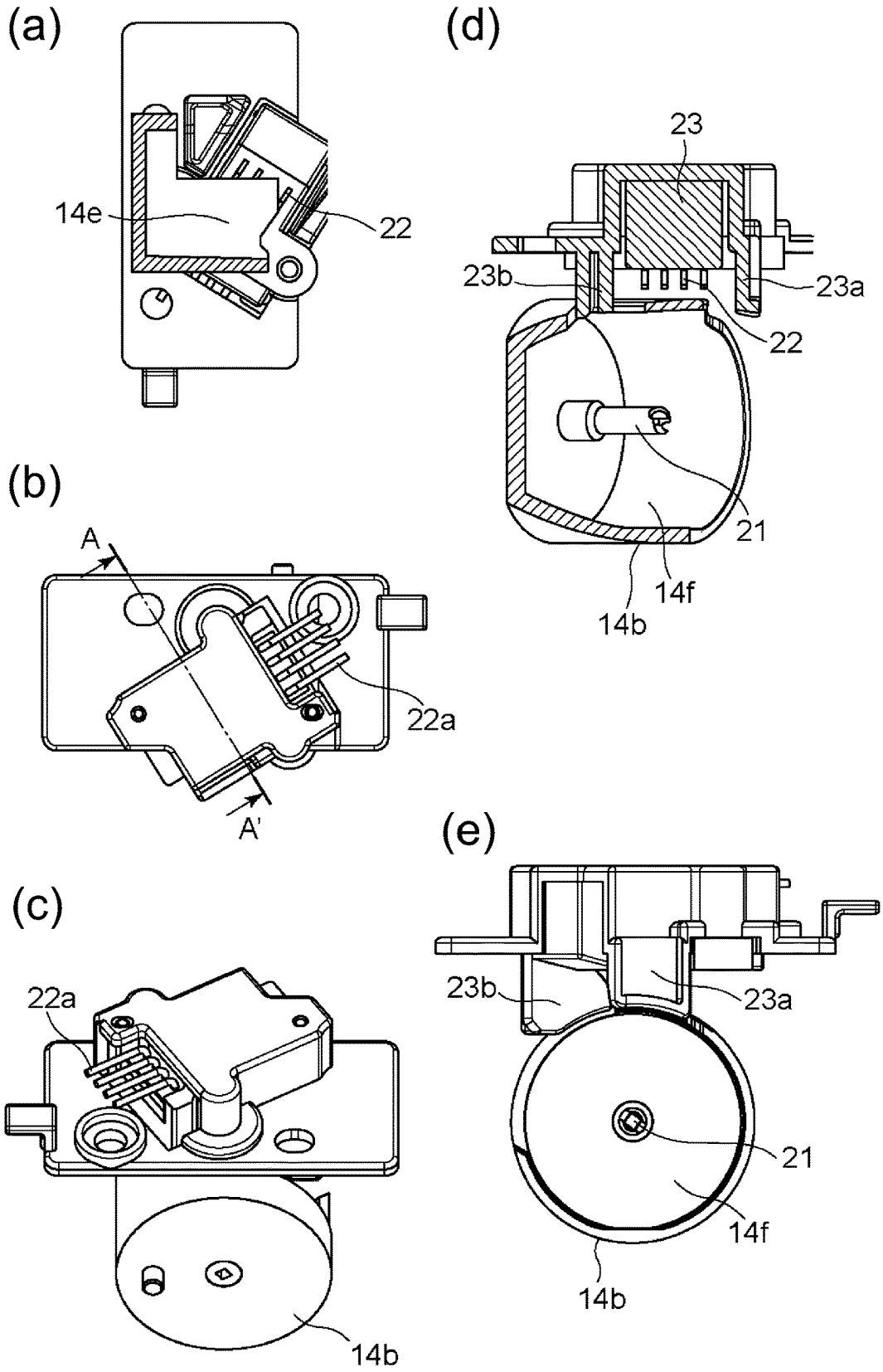

Parts (a), (b), (c), (d) and (e) of FIG. 4 are views illustrating a structure around the electrical connecting portion of the mounting portion.

Figure 5:
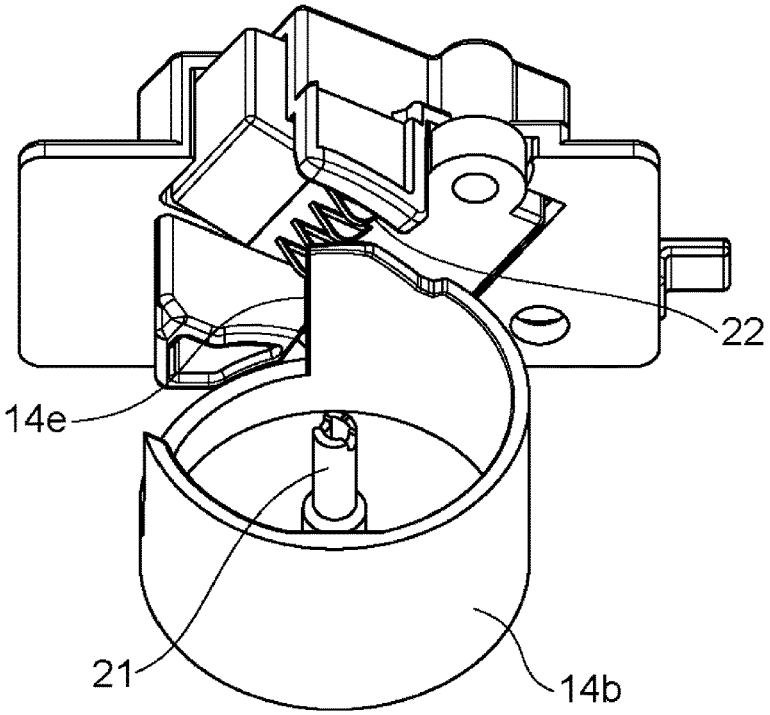
Figure 5:
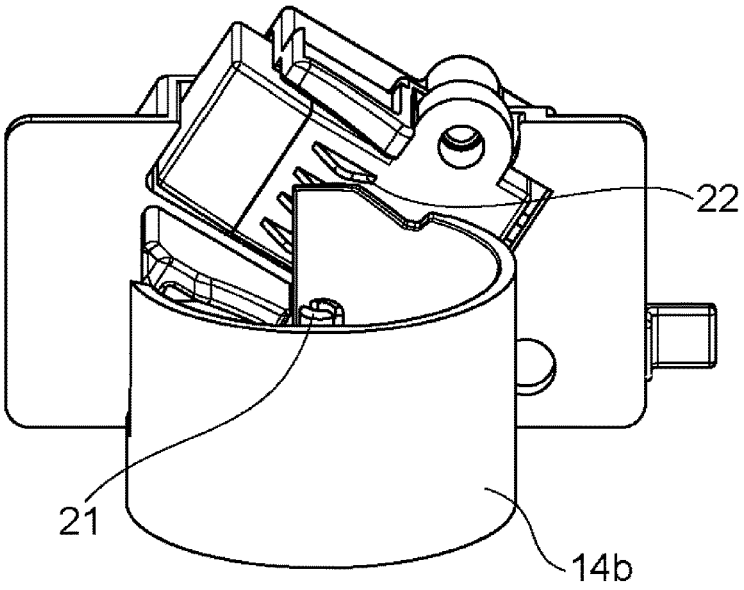

Parts (a) and (b) of FIG. 5 are perspective views illustrating the structure around the electrical connecting portion of the mounting portion.

Figure 6:
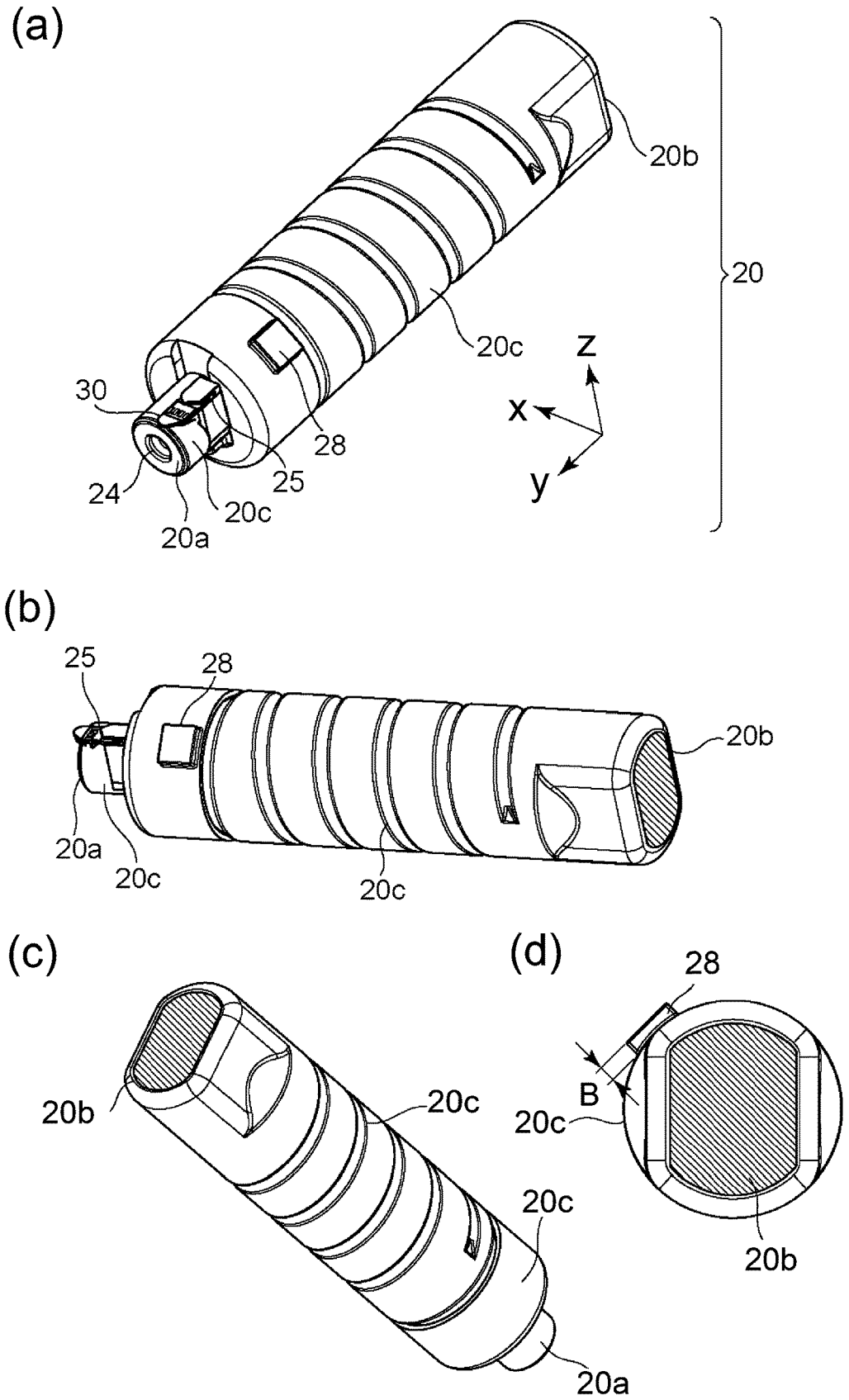

Parts (a), (b), (c) and (d) of FIG. 6 are illustrations of a structure of an ink cartridge.

Figure 7:
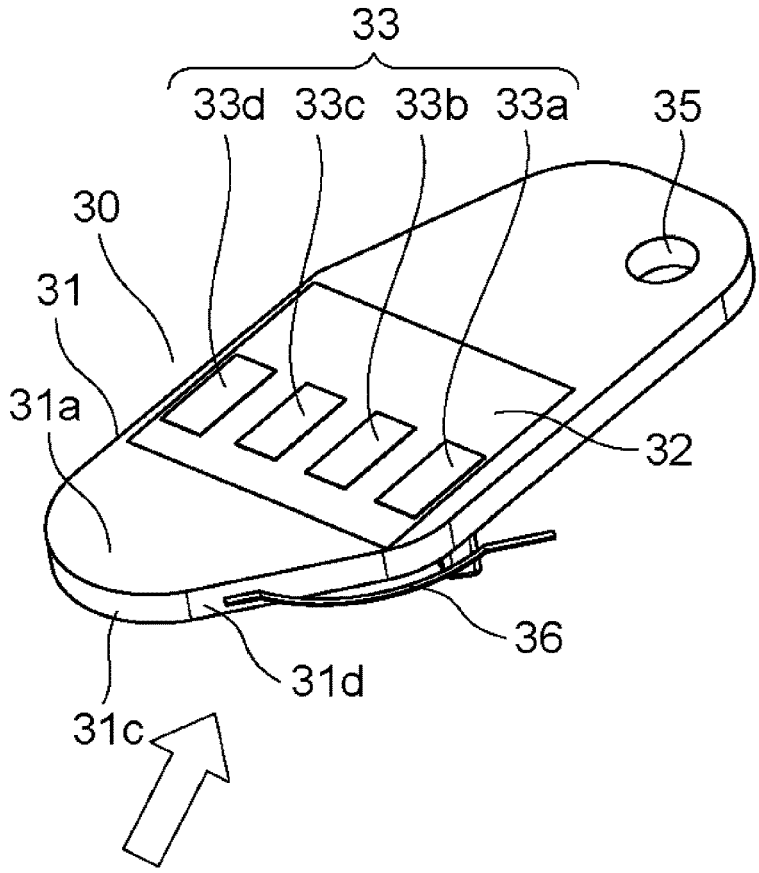
Figure 7:
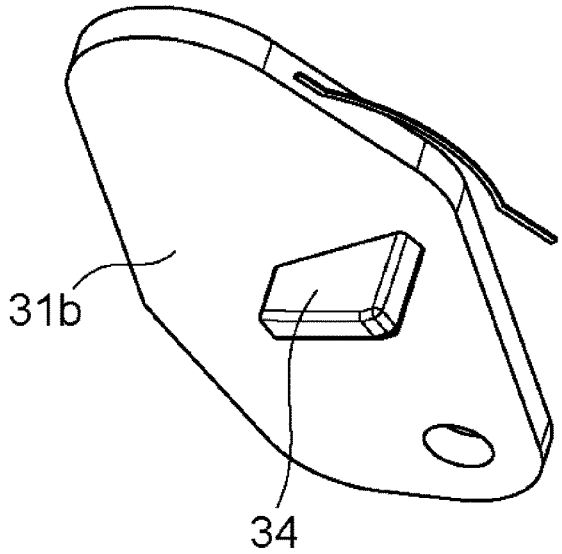

Parts (a) and (b) of FIG. 7 are illustrations of a structure of an electrode unit.

Figure 8:
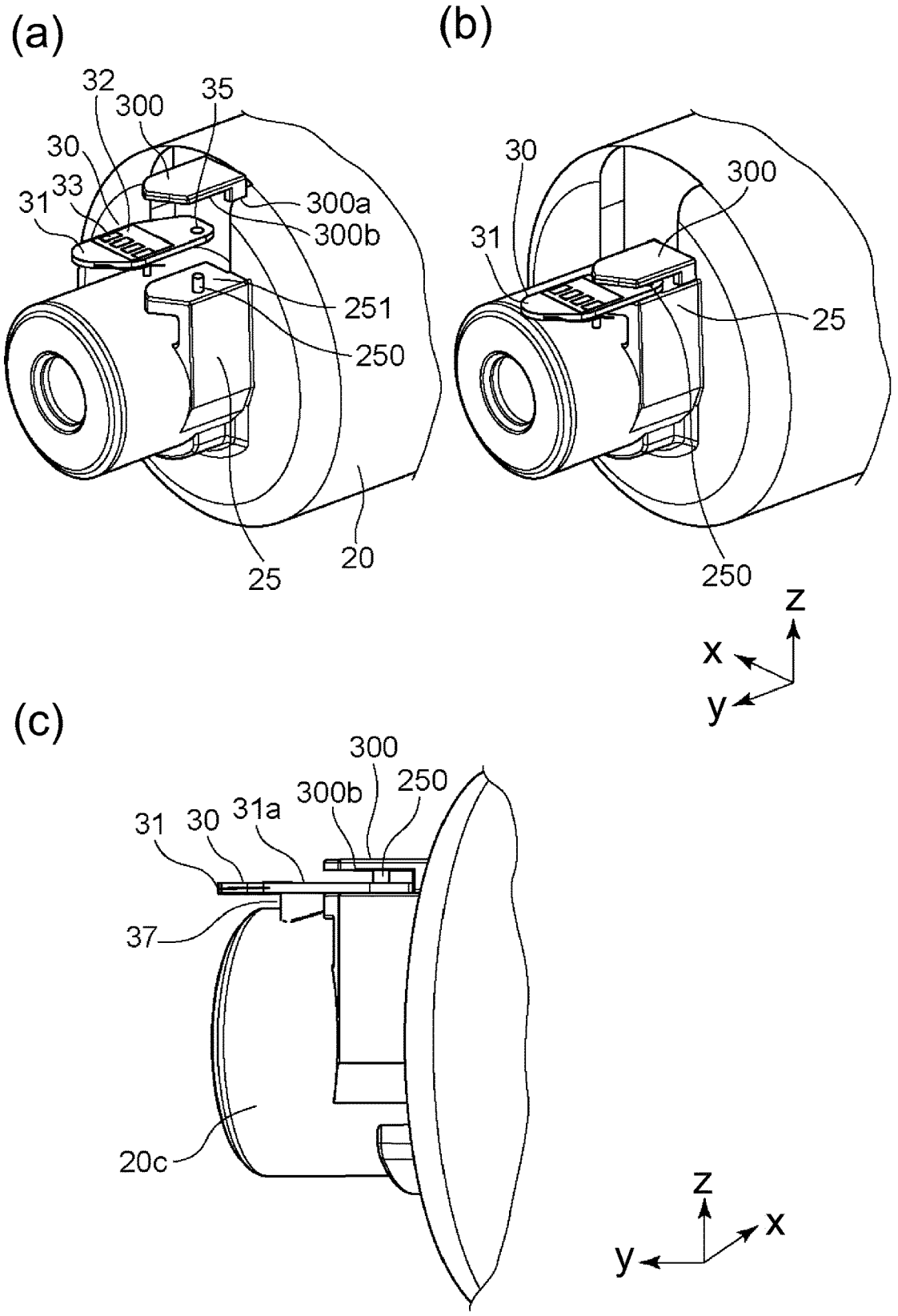

Parts (a), (b) and (c) of FIG. 8 are illustrations of a structure of an electrode unit.

Figure 9:
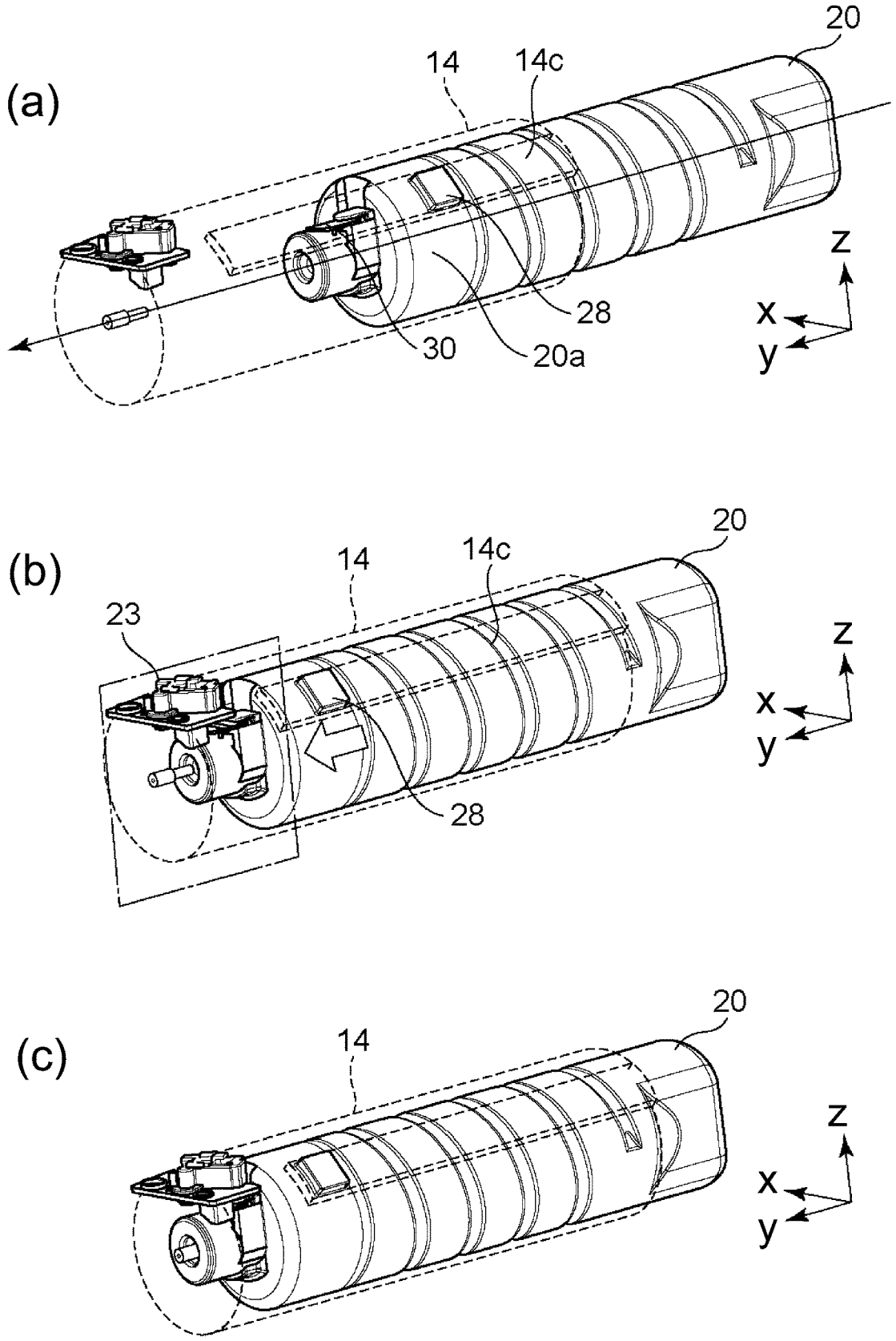

Parts (a), (b) and (c) of FIG. 9 are illustrations of a state where an ink cartridge is being mounted.

Figure 10:
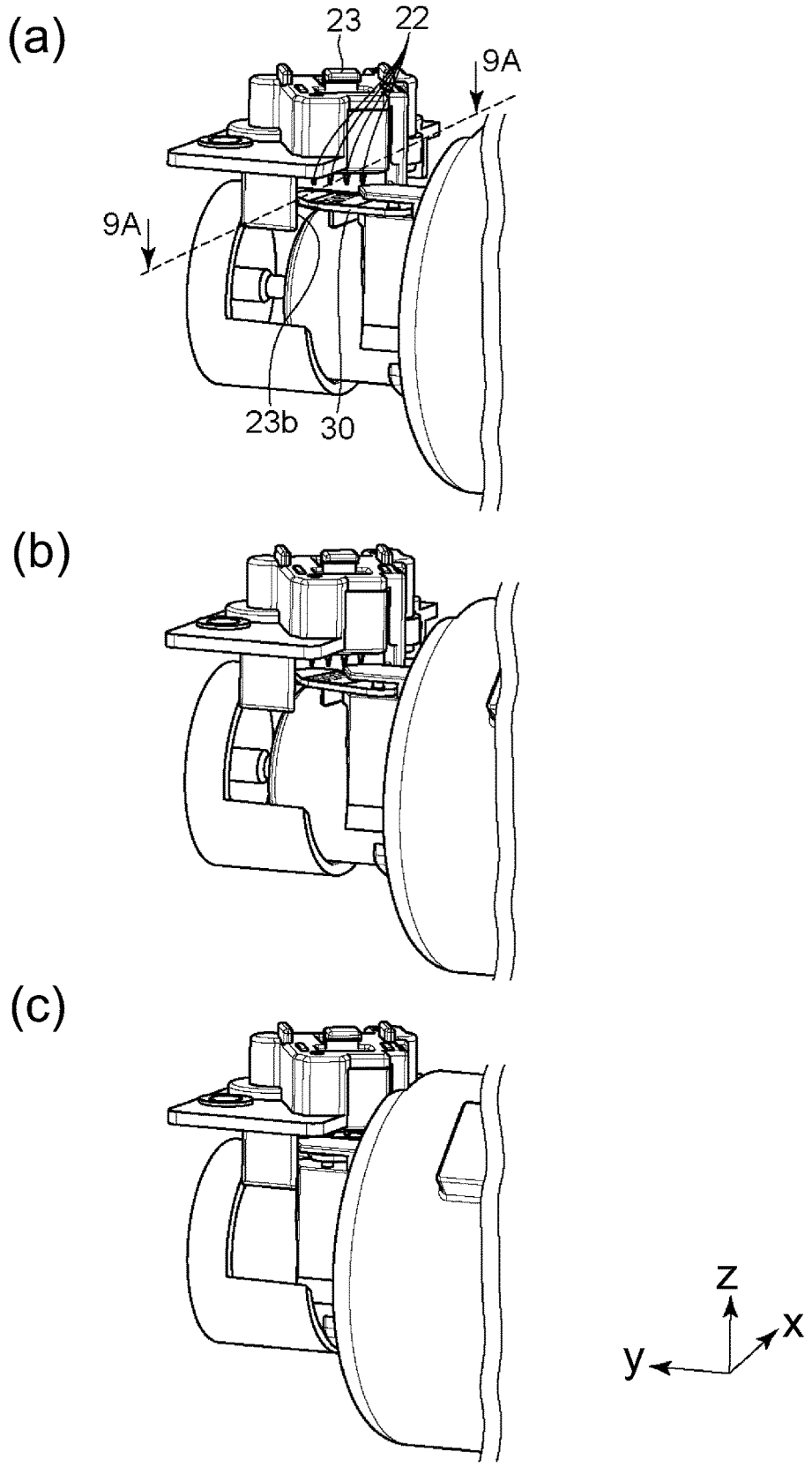

Parts (a), (b) and (c) of FIG. 10 are illustrations of a state of rotation of the electrode unit.

Figure 11:
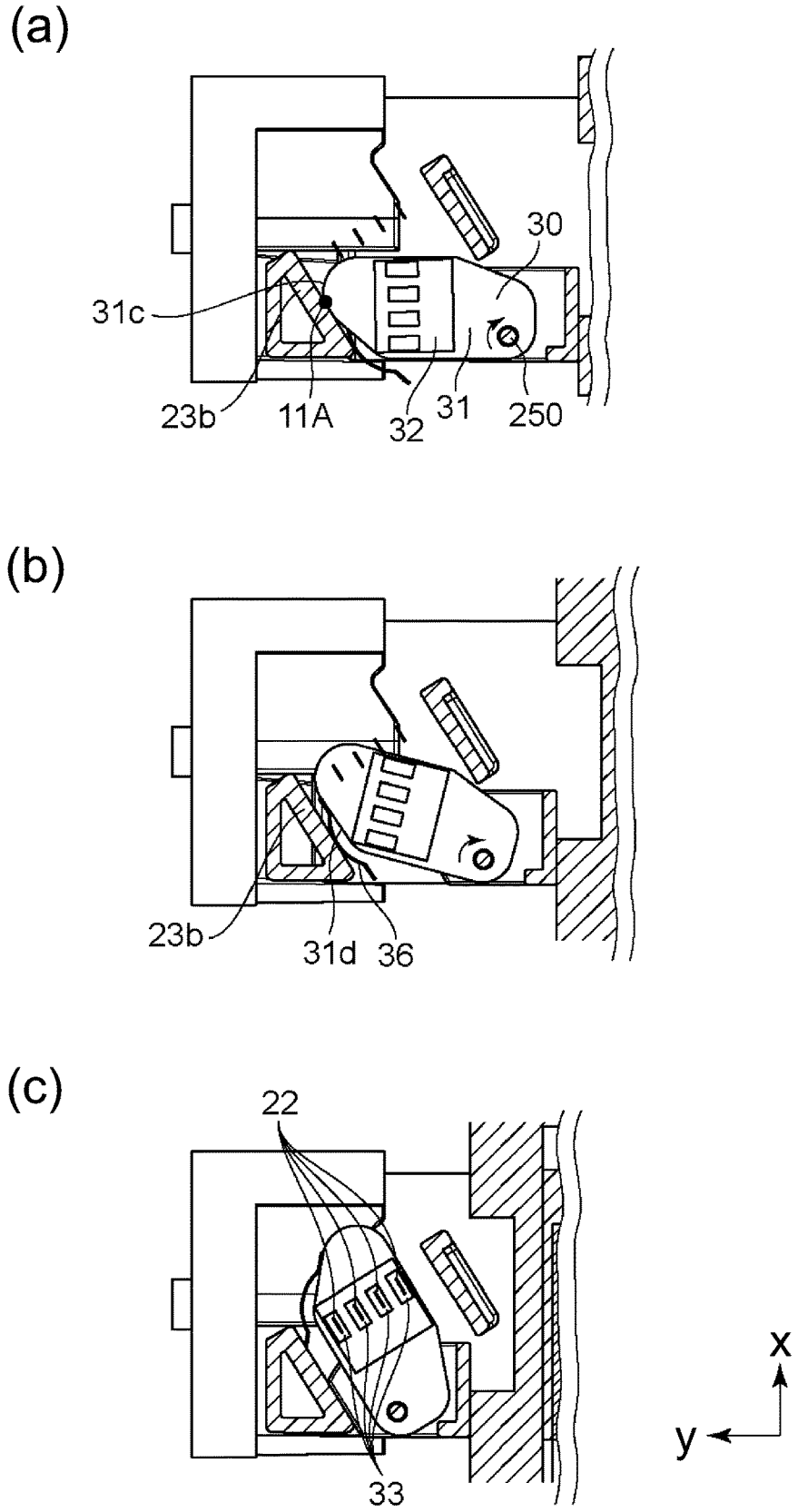

Parts (a), (b) and (c) of FIG. 11 are illustrations of a state of rotation of the electrode unit.

Figure 12:
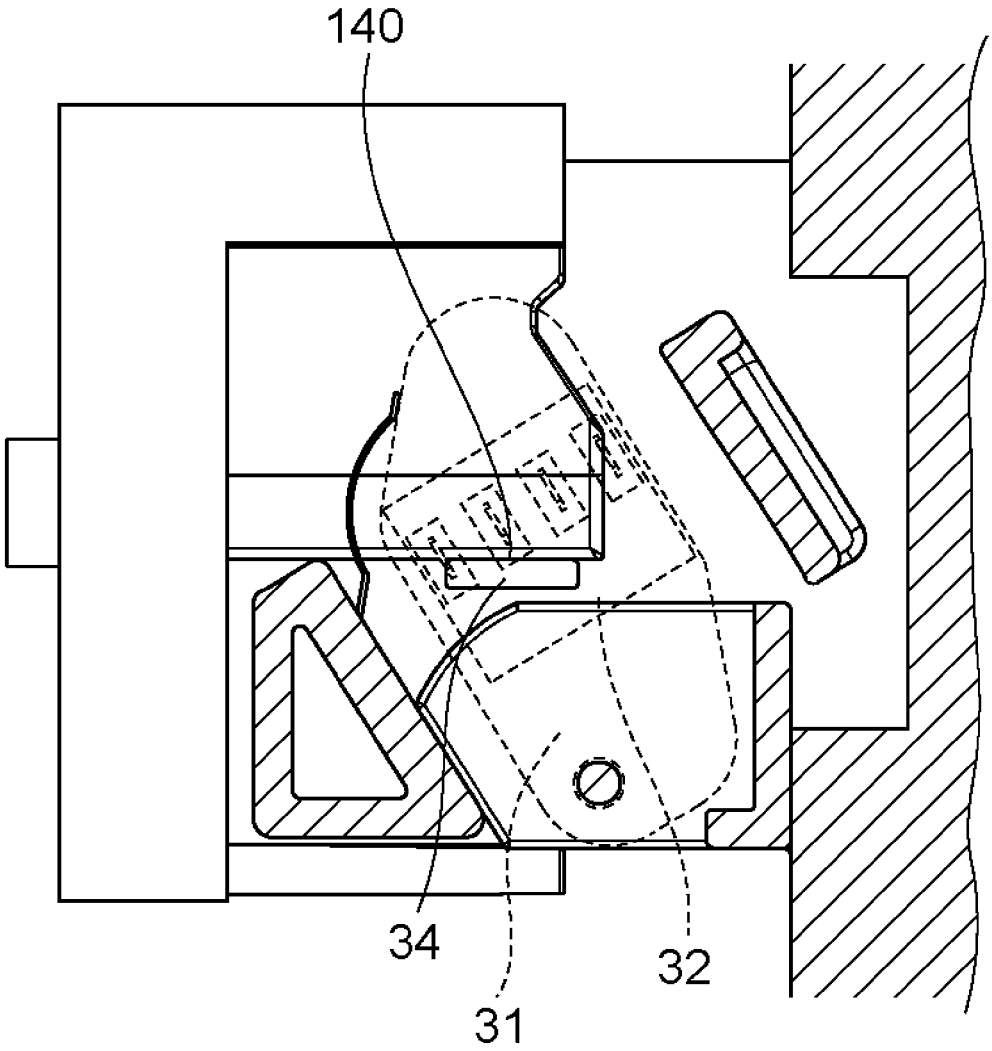

FIG. 12 is a view illustrating a rotation restricting portion for the electrode unit.

Figure 13:
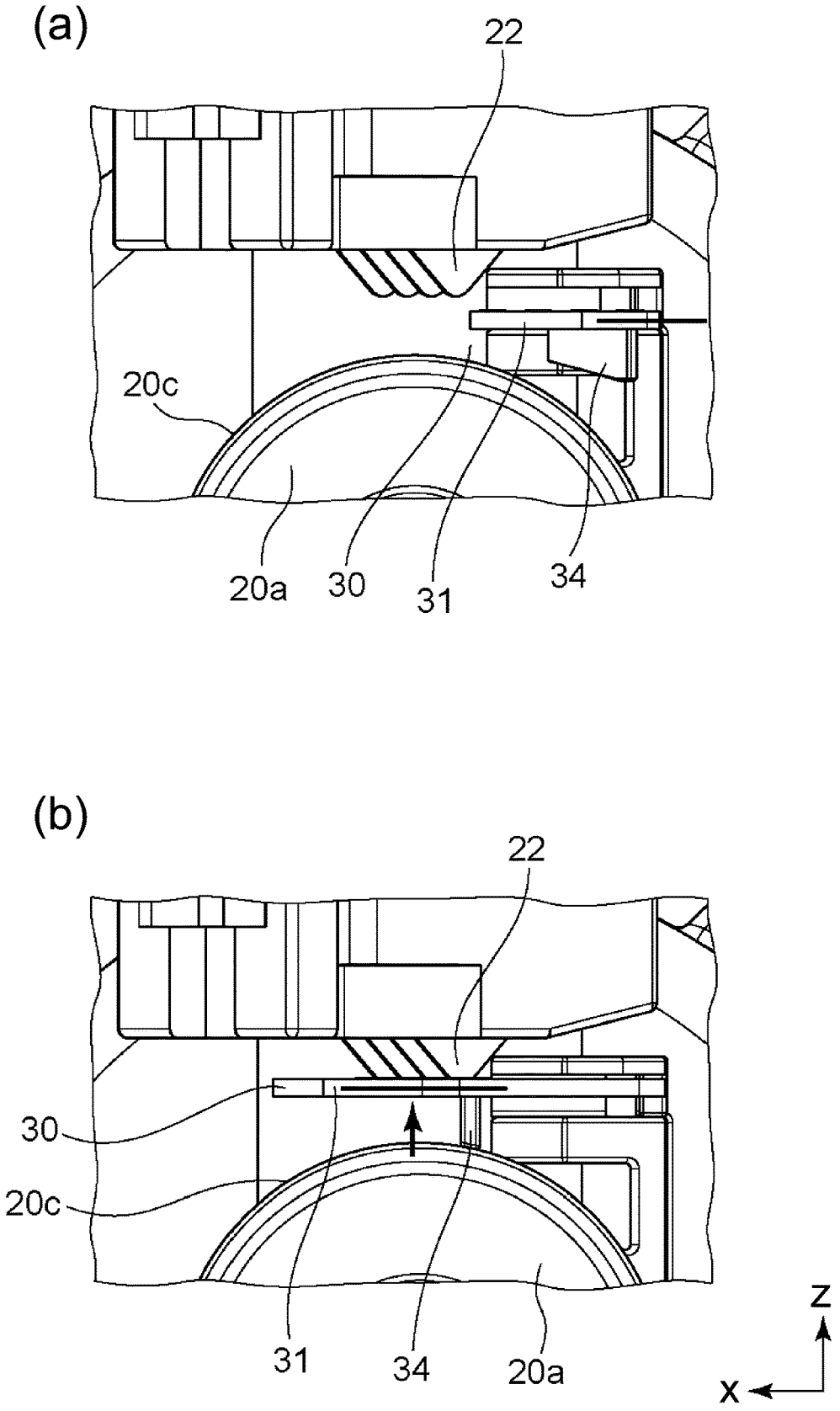

Parts (a) and (b) of FIG. 13 are illustrations of movement of the electrode unit.

Figure 14:
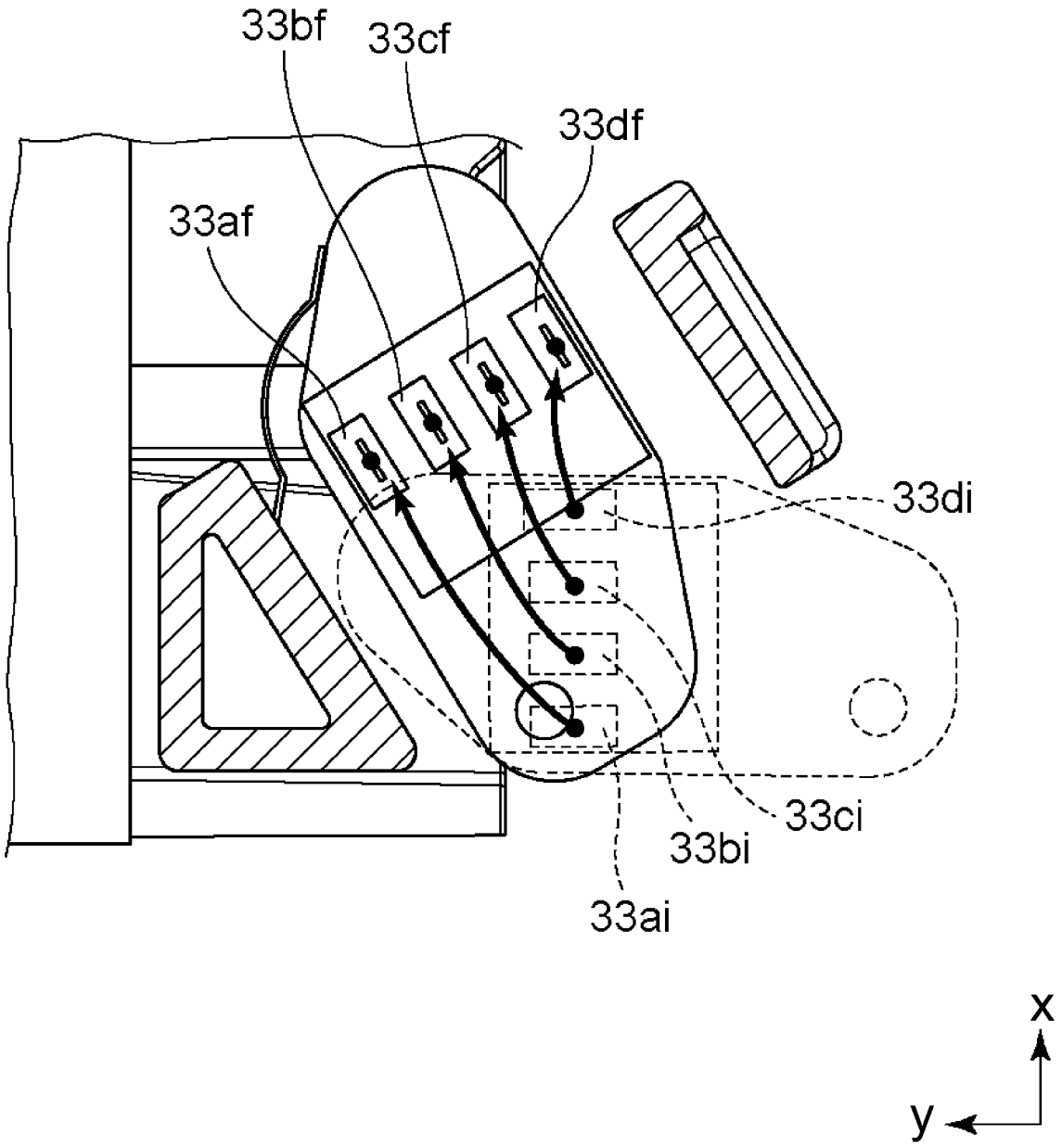

FIG. 14 is an illustration of a trace of rotation of a pad electrode.

Figure 15:
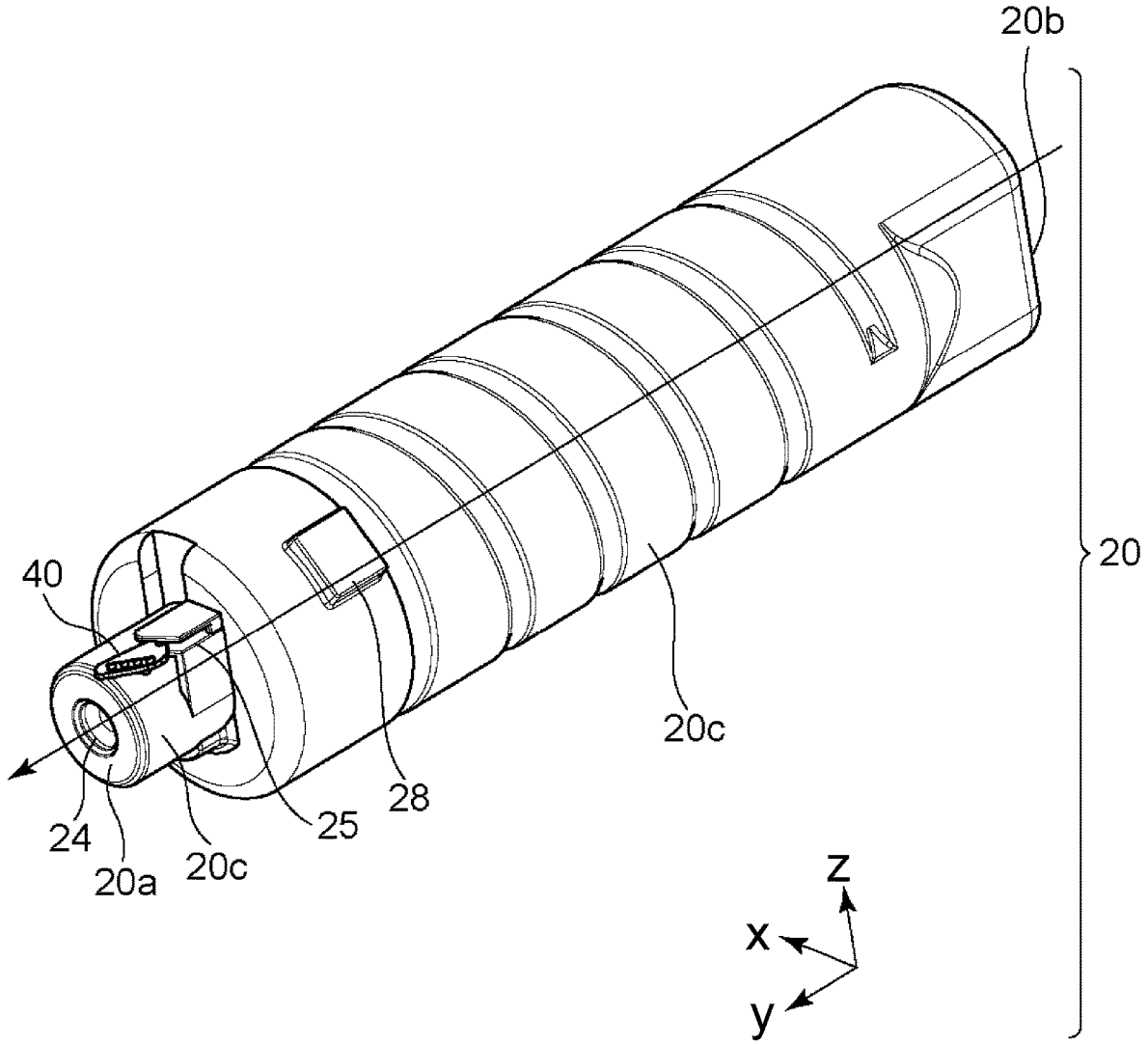

FIG. 15 is an illustration of a structure of an ink cartridge.

Figure 16:
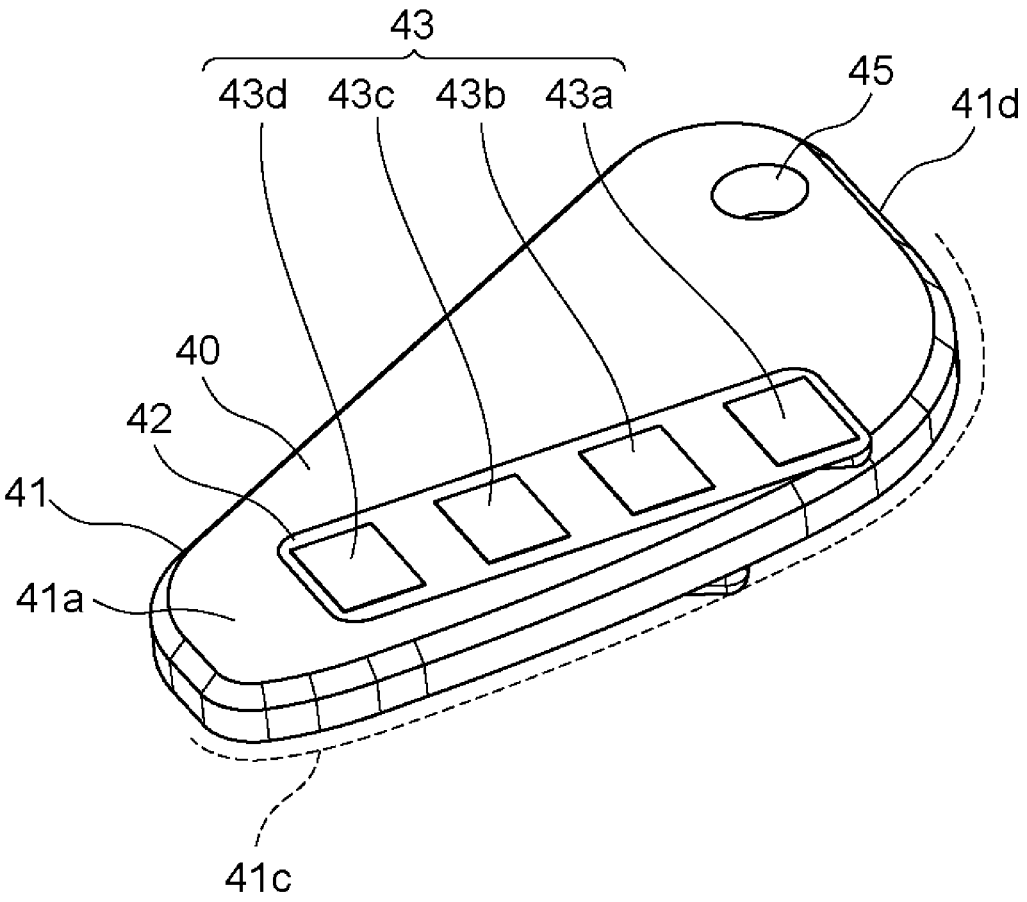

FIG. 16 is an illustration of a structure of an electrode unit.

Figure 17:
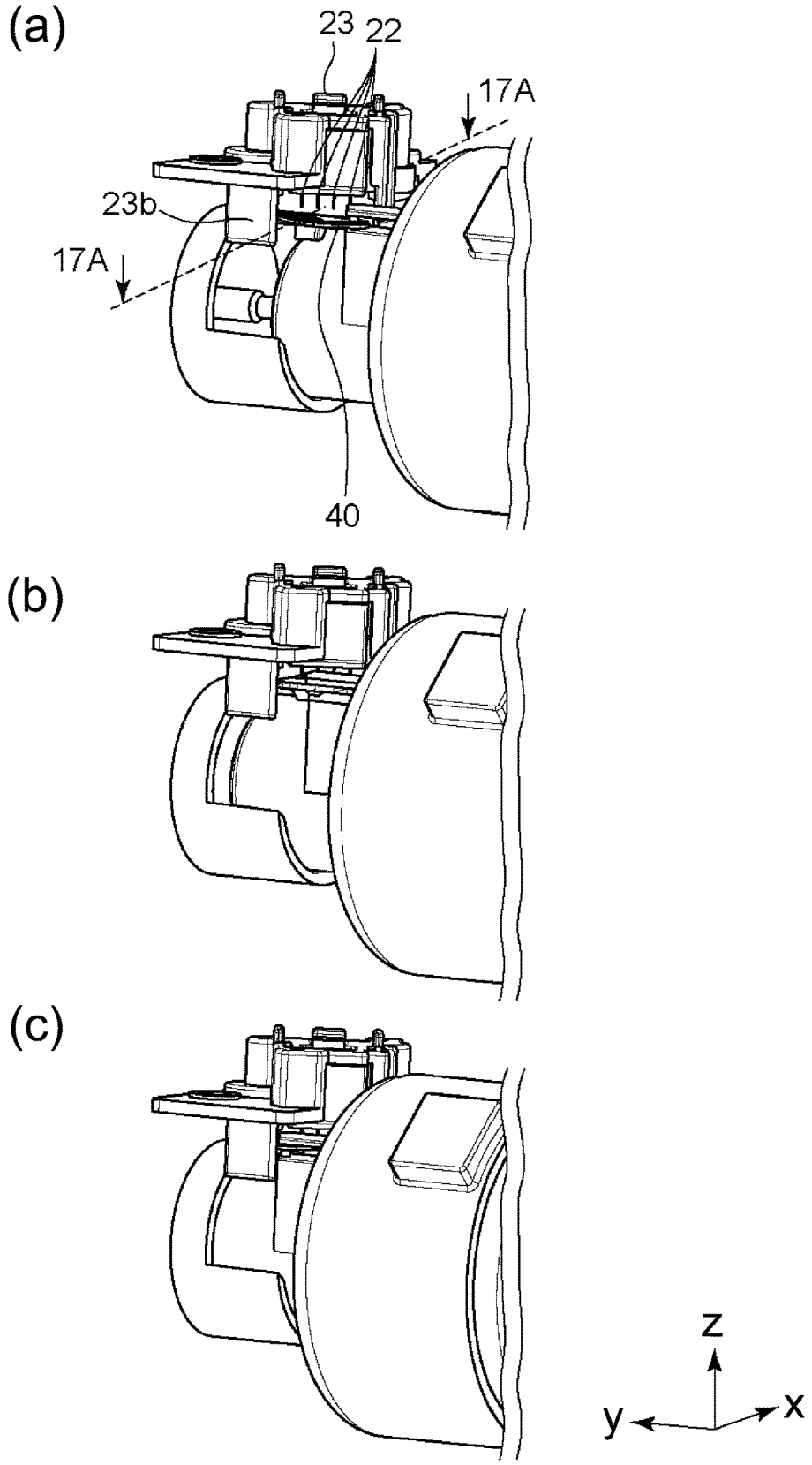

Parts (a), (b) and (c) of FIG. 17 are illustrations of a state of rotation of the electrode unit.

Figure 18:
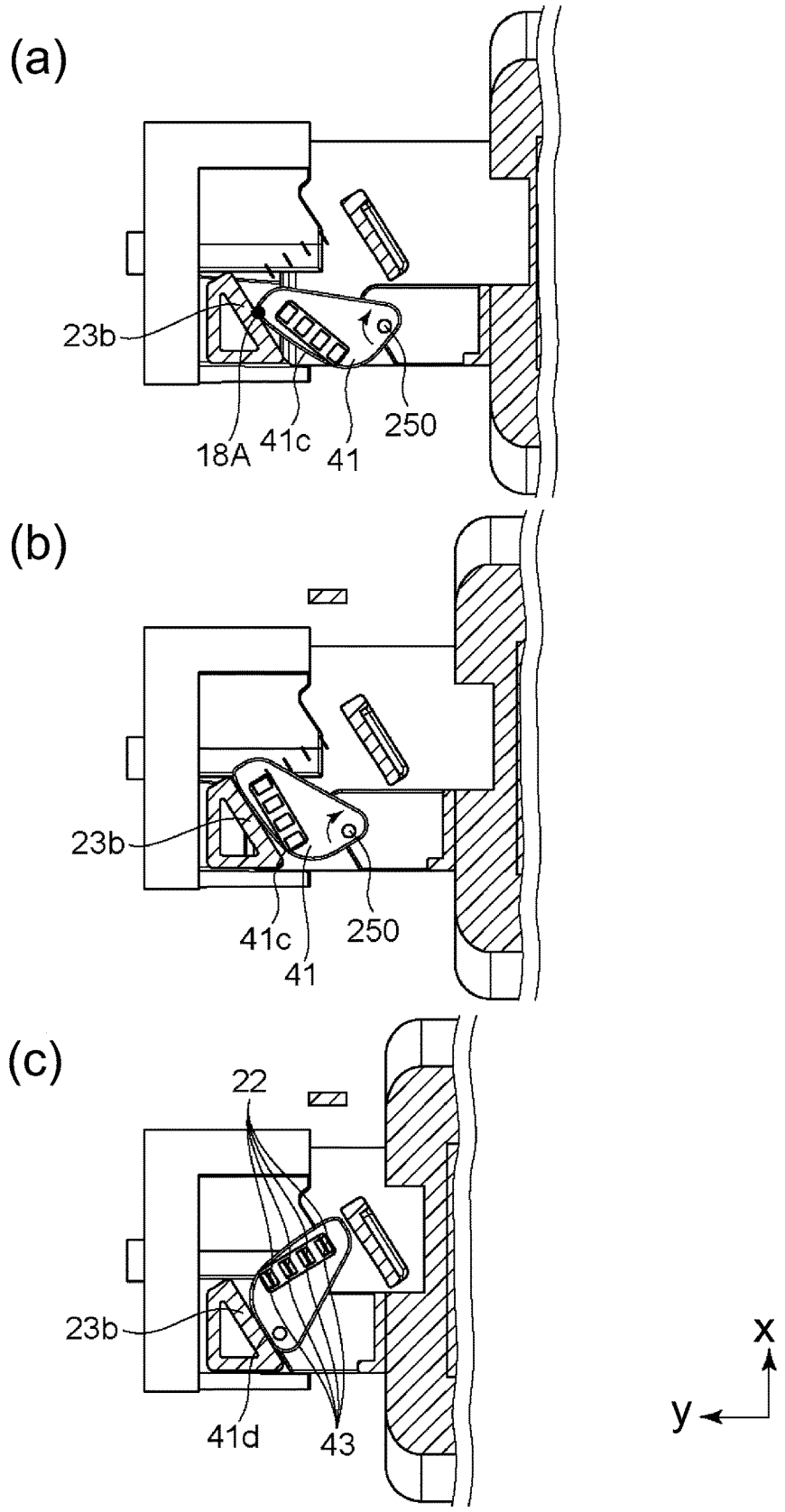

Parts (a), (b) and (c) of FIG. 18 are illustrations of a state of rotation of the electrode unit.

Figure 19:
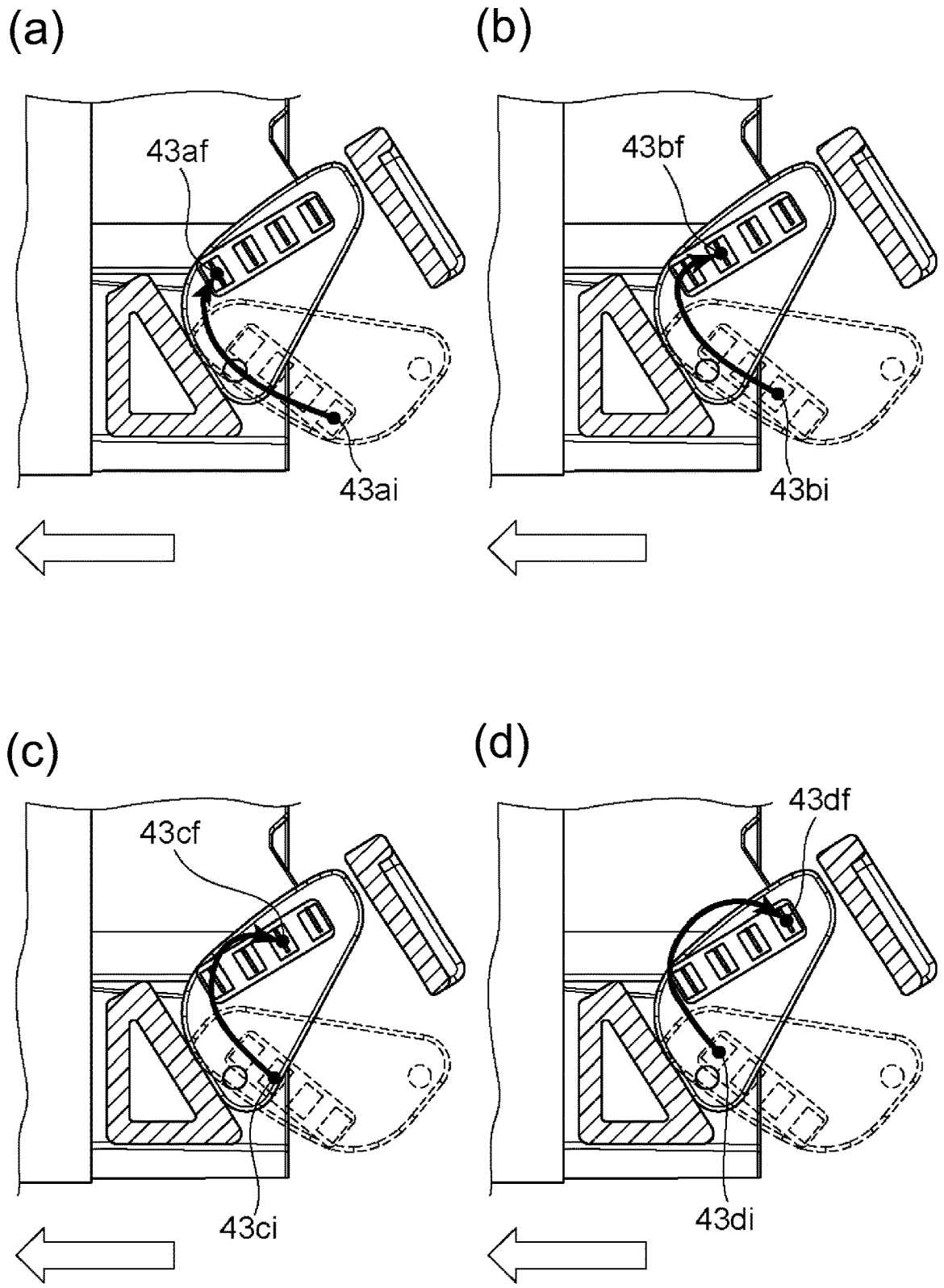

Parts (a), (b), (c) and (d) of FIG. 19 are illustrations of a trace of rotation of the pad electrode.

EMBODIMENTS FOR CARRYING OUT THE INVENTION

According to the investigation by the inventors of the present invention, when the ink cartridge disclosed in Japanese Laid-open Patent Application No. 2008-273173 is mounted in the recording apparatus, if the mounting force is strong, the contact between the connection terminals of the recording apparatus and the pad electrodes of the ink cartridge may not be good enough in some cases.

That is, in the prior art, there is room for improvement on the member (ink cartridges) including the pad electrodes and the recording apparatus to which the member is mounted.

In the following, embodiments of the member, the ink cartridge, and the recording apparatus according to the present invention will be specifically described in conjunction with the drawings. Here, each of the following embodiments is a preferable example for carrying out the present invention, and the present invention is not limited to the structures of such examples. In addition, the contents described in each embodiment can be combined with a part or parts of the description content.

Embodiment 1

First, an example in which an ink jet printer is used as a recording apparatus, and in which an ink cartridge is used as the mountable member will be described.

<Recording Apparatus>

(Overall Structure)

Figure 1:
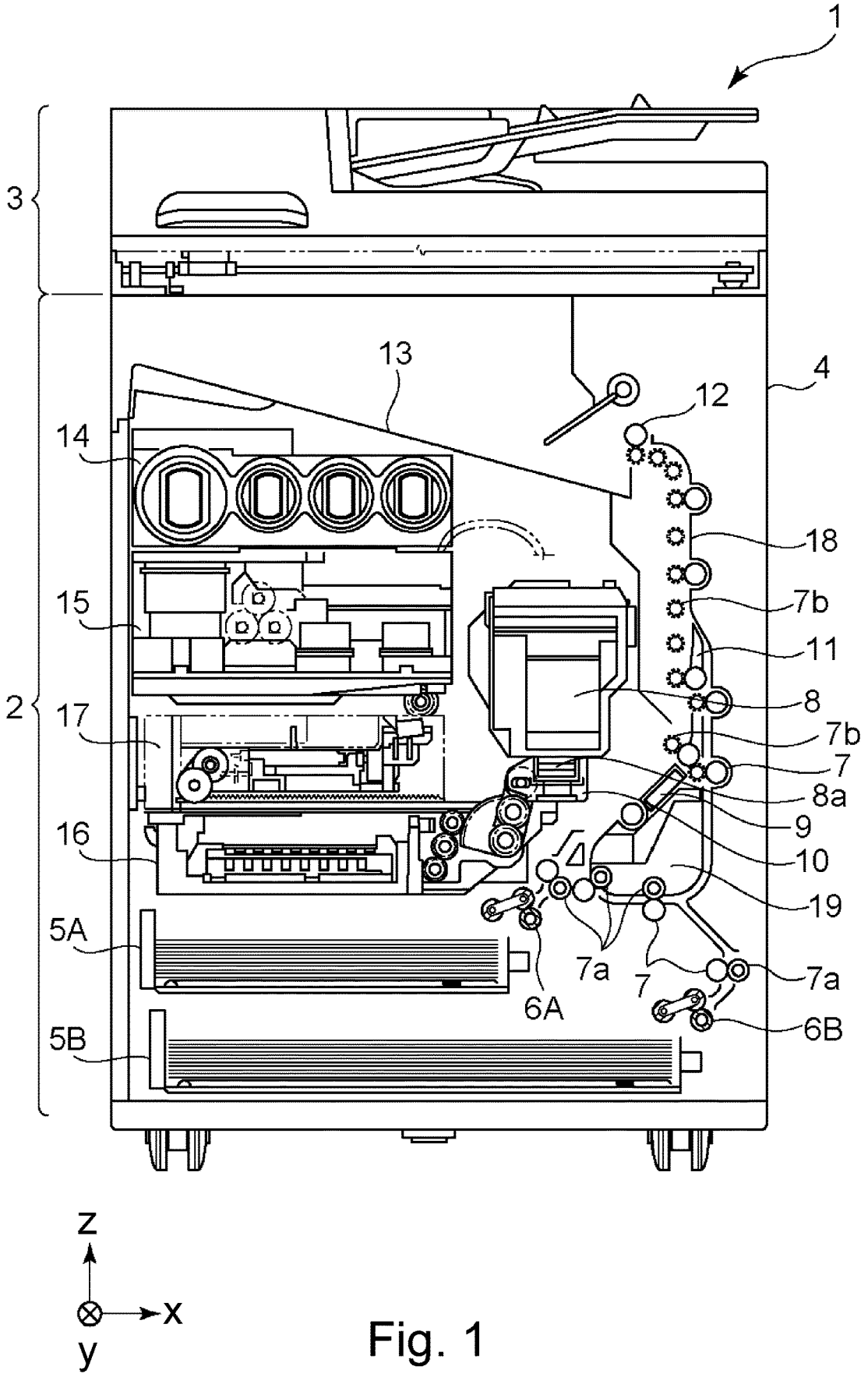
FIG. 1 is an illustration showing a structure of an ink jet printer.

Referring to FIG. 1, the overall structure of an inkjet printer 1 (hereinafter referred to as a recording apparatus 1) as an example of a recording apparatus will be described FIG. 1 is an internal structure illustration of the recording apparatus 1. In FIG. 1, a x direction indicates the horizontal direction, a y direction (the direction perpendicular to the sheet of the drawing) indicates the direction in which the discharge openings are arranged in the recording head 8 described later, and the z direction indicates the direction of gravity (vertical direction). Here, the x direction, the y direction and the z direction shown in FIG. 1 are usable with the same meaning also in the drawings after FIG. 1. For example, the x direction, the y direction and the z direction shown in Parts (a) and (b) of FIG. 2 are directions same as the x direction, the y direction and the direction shown in FIG. 1, respectively.

The recording apparatus 1 is a multifunction machine including a printing portion 2 and a scanner portion 3 above the printing portion 2, and various processes relating to a recording operation and a reading operation are individually or in interrelation with the printing portion 2 and the scanner portion 3 can be executed. The scanner portion 3 is equipped with ADF (Automatic Document Feeder) and FBS (Flat Bed Scanner), and it is possible to scan originals automatically fed by the ADF and to read originals placed on the platen of the FBS by the user. Here, FIG. 1 shows a multifunction peripheral including both the printing unit 2 and the scanner unit 3, but the scanner unit 3 may not be provided. FIG. 1 shows a state in which the recording apparatus 1 is in a stand-by state in which neither the recording operation nor the reading operation is carried out.

In the printing unit 2, a first cassette 5A and a second cassette 5B for storing a recording material (cut sheet) S are dismountably mounting at a bottom portion of the casing 4 downwardly in the gravity direction. Relatively small recording materials up to A4 size are accommodated in the first cassette 5A and relatively large recording materials up to A3 size are accommodated in the second cassette 5B in the form of a flat stack. In the neighborhood of the first cassette 5A, there is provided a first feeding unit 6A for separating and feeding the stored recording materials one by one. Similarly, in the neighborhood of the second cassette 5B, the second feeding unit 6B is provided. When the recording operation is carried out, the recording material S is selectively fed from one of the cassettes.

A feeding roller 7, a discharge roller 12, a pinch roller 7*a*, a spur 7*b*, a guide 18, an inner guide 19 and a flapper 11 are feeding mechanisms for guiding to feed the recording material S in a predetermined direction. The feeding rollers 7 are disposed on an upstream side and a downstream side of the recording head 8 and are driving rollers driven by a feeding motor (not shown). The pinch roller 7*a* is a driven roller that rotates while nipping the recording material S together with the feeding roller 7. The discharging roller 12 is a driving roller which is disposed on the downstream side of the feeding roller 7 and is driven by a feeding motor (not shown). The spur 7*b* sandwiches and feeds the recording material S together with the feeding roller 7 and the discharge roller 12 provided on the downstream side of the recording head 8.

The guide 18 is provided in the feeding path of the recording material S and guides the recording material S in a predetermined direction. The inner guide 19 extends in the y direction, has a curved side surface, and guides the recording material S along the side surface. The flapper 11 is for switching the direction in which the recording material S is fed during the duplex recording operation. The discharge tray 13 is for stacking and holding the recording materials S discharged by the discharge roller 12 after completion of the recording operation.

The recording head 8 shown in FIG. 1 is a full-line type ink jet recording head, in which ejection openings for injecting ink in accordance with recording data are arranged in the y direction in FIG. 1, and the number of ejection openings are enough to cover width of the recording material S. In addition, it is an inkjet recording head capable of color printing. When the recording head 8 is in the standby position, the ejection opening surface 8*a* of the recording head 8 is capped by the cap unit 10 as shown in FIG. 1. When performing the recording operation, the direction of the recording head 8 is changed by the print controller so that the ejection opening surface 8*a* faces the platen 9. The platen 9 is constituted by a flat plate extending in the y direction, and supports the recording material S on which the recording operation is performed by the recording head 8, at the back side of the recording material S.

The recording head 8 need not necessarily be a full-line type recording head, but may be a serial-scan type recording head that reciprocates in a direction crossing the feeding direction of the recording material S.

A mounting portion 14 is a portion to which the ink cartridge is mounted. The mounting portion 14 may be made dismountable from the recording apparatus 1. Here, in this example, four ink cartridges are mounted on the mounting portion 14, and these ink cartridges store the four colors of ink to be supplied to the recording head 8, respectively. The ink supply unit 15 is provided in the middle of a flow path connecting the mounting portion 14 and the recording head 8 and adjusts the pressure and the flow rate of the ink in the recording head 8 to appropriate levels. In addition, in this example, a circulation type ink supply "system" is employed, and the ink supply unit 15 adjusts the pressure of the ink supplied to the recording head 8 and the flow rate of the ink returning from the recording head 8 within appropriate ranges.

The maintenance unit 16 includes a cap unit 10 and a wiping unit 17 and operates at a predetermined timing to perform a maintenance operation on the recording head 8.

Here, "ink" as used herein includes any liquid that can be used for image formation or processing of a recording material by being applied to a recording material. Therefore, "ink" as used herein includes any liquid that can be used for recording. In addition, the recording is not limited in particular, and it can be applied to industrial applications and the like. For example, they can be used for biochip production, electronic circuit printing, semiconductor substrate production, and so on.

(Mounting Portion)

Parts (a) and (b) of FIG. 2 shows a view of the mounting portion 14 of the recording apparatus 1 of FIG. 1 as viewed obliquely from above in the direction of gravity, in which the mounting portion 14 is omitted. Part (a) of FIG. 2 is an illustration showing a state before the ink cartridge is mounted to the mounting portion 14. Part (b) of FIG. 2 is an illustration showing a state after the ink cartridge 20 is mounted to the mounting portion 14.

The mounting portion 14 shown in Parts (a) and (b) of FIG. 2 includes four cylindrical hole forming members 14*a*. Each hole forming member 14*a* forms a hole 14*d*. The ink cartridge 20 is inserted into the hole 14*d* formed by the hole forming member 14*a* of the mounting portion 14 and mounted to the mounting portion 14 of the recording apparatus. It is not always necessary to provide a plurality of hole forming members 14*a*. For example, one hole forming member may include a plurality of holes. It is preferred that the diameter of the hole 14*d* (the dimension measured in the direction perpendicular to the extending direction of the hole 14*d*) is 50 mm or more and 90 mm or less. Here, if the cross-section taken in the direction perpendicular to the extending direction of the hole 14*d* is not a perfect circle, the diameter of the hole 14*d* is assumed to be the circle equivalent diameter. Similarly, in the present specification, the "equivalent diameter" is taken as "diameter" unless otherwise specified.

On the back side of the hole forming member 14*a*, another hole forming member 14*b* different from the hole forming member 14*a* is provided. When mounting the ink cartridge, the side where the hole forming member 14*a* is provided is the front side, and the side provided with the hole forming member 14*b* is the rear side. The hole forming member 14*b* is also provided with a hole (not shown in Parts (a) and (b) of FIG. 2), and the hole 14*d* of the hole forming member 14*a* and the hole of the hole forming member 14*b* communicate with each other inside the mounting portion 14. The ink cartridge 20 is inserted into this communicated hole. Here, the hole forming member 14*a* and the hole forming member 14*b* may not be provided as separate members, and, for example, two hole forming members may be integrated. Examples of materials for forming the hole forming member 14*a* include ABS (acrylonitrile-butadiene-styrene copolymer resin), PPO (modified polyphenylene oxide), HIPS (high impact polystyrene resin), and the like. Materials for forming the hole forming member 14*b* include PE (polyethylene), PP (polypropylene), PPO (modified polyphenylene oxide), and the like.

At the opening on the front side of the hole 14*d* of the hole forming member 14*a*, an ID recess 14*c* is provided. The ID recess 14*c* is used for roughly aligning the ink cartridge 20 relative to the mounting portion 14 when the ink cartridge 20 is mounted. In Parts (a) and (b) of FIG. 2, the circular opening of the hole 14*d* is partially recessed to form the ID recess 14*c*.

A plurality of electrical connecting portions (not shown in Parts (a) and (b) of FIG. 2) are provided in the mounting portion 14 so as to be in contact with the respective pad electrodes of the ink cartridge and to be electrically connected with the pad electrodes by physical contact therebetween. In Parts (a) and (b) of FIG. 2, the electrical connecting portion is provided in the hole forming member 14*b* of the mounting portion 14.

FIG. 3 schematically is an enlarged view of the hole forming member 14*b* around the electrical connecting portion. FIG. 3 is a view of a cross portion of the mounting portion 14 (hole forming member 14*b*) in a portion surrounded by a portion A in part (a) of FIG. 2. Here, in FIG. 3, a part of the mounting portion 14 including the hole forming member 14*a* is omitted, for simplicity of illustration.

As shown in FIG. 3, the hole forming member 14*b* is a tubular member, and a hole 14*f* is formed inside the hole forming member 14*b*. The tubular ink receiving tube 21 projects from the rear side surface of the hole 14*f* (the bottom surface of the hole 14*f* formed by the hole forming member 14*b*). The surface on the rear side of the hole 14*f* is circular, and the ink receiving tube 21 projects from a center of the circular surface in a direction (extending direction) perpendicular to the surface. The ink receiving tube 21 is a tube for receiving the ink supplied from the ink cartridge mounted to the mounting portion 14. The ink receiving tube 21 is connected to the recording head of the recording apparatus by way of the ink flow path, and supplies the ink received from the ink cartridge to the recording head. One ink receiving tube corresponds to one color ink. Therefore, it is preferable to provide ink receiving tubes for the ink color used, respectively. Examples of materials forming the ink receiving tube 21 include SUS (stainless steel), PPO (modified polyphenylene oxide) and the like. It is preferred that the diameter of the ink receiving tube 21 (the diameter in the cross-section perpendicular to the extending direction of the ink receiving tube 21) is 2 mm or more and 5 mm or less. Further preferably, it is 3 mm or more and 4 mm or less. Here, it is preferred that the diameter of the hole 14*f* (the diameter measured in the direction perpendicular to the extending direction of the hole 14*f*) is 20 mm or more and 30 mm or less. It is preferred that the diameter of hole 14*f* is smaller than the diameter of hole 14*d*.

As shown in FIG. 3, the mounting portion 14 is provided with a plurality of electrical connecting portions 22. The electrical connecting portion 22 may be in the form of a connector pin or the like. The electrical connecting portion 22 is provided in the electrical connecting portion peripheral portion 23 which is a part of the mounting portion 14. Copper alloy (gold-plated) or the like can be used as a material for forming the electric connecting portion 22. Examples of materials forming the electrical connecting portion peripheral portion 23 include ABS (acrylonitrile-butadiene-styrene copolymer resin), PC (polycarbonate), and the like.

The plurality of electrical connecting portions 22 are interposed between walls 23*a*, 23*b* of the electrical connecting portion peripheral portion 23. The walls 23*a* and 23*b* are opposed to each other with the plurality of electric connecting portions 22 interposed therebetween and at least one of the walls performs the function as a guide for rotating the electrode portion when mounting the ink cartridge as will be described hereinafter. As the material for forming the positioning walls 23*a* and 23*b*, PPO (modified polyphenylene oxide), ABS (acrylonitrile-butadiene-styrene copolymer resin), SUS (stainless steel) and the like can be used. Here, the electrical connecting portion peripheral part 23 may be dismountably from the mounting portion 14. In addition, the electrical connecting portion peripheral portion 23 may not be provided in the hole forming member 14*b*, but may be provided separately from the hole forming member 14*b*.

Next, the structure of the electrical connecting portion 22 and the electrical connecting portion peripheral portion 23 will be described in more detail. First, the view of the periphery of the electrical connection portion 22 in the direction of the arrow An in FIG. 3 is shown in part (a) of FIG. 4. The direction of the arrow An in FIG. 3 is the direction (z direction) heading from the lower side to the upper side with respect to the direction of gravity in the attitude of using the recording apparatus. The attitude of using the recording apparatus is the attitude in which the recording apparatus is placed when recording is carried out by the recording apparatus, and it is the attitude shown in FIG. 1. Here, "gravity direction" in this specification means the direction of gravity in the attitude in which the recording apparatus is used unless otherwise specified. In the direction of the arrow A, the hole forming member 14*b* and the electrical connecting portion 22 are visible. The hole forming member 14*b* visible here can support the pad electrode of the ink cartridge and can restrict the movement of the pad electrode in the vertical direction (gravity direction). By this restriction of movement, the hole forming member 14*b* serves as a supporting member for stabilizing the mounting of the ink cartridge (In this sense, the hole forming member 14*b* is a supporting member 14*e*). As shown in part (a) of FIG. 4, as viewed in the direction of arrow A, the hole forming member 14*b* covers a part of the electric connecting portion 22. Here, the hole forming member 14*b* is not limited to the form covering a part of the electric connecting portion 22 as shown here, but it may be formed so as not to cover the electric connecting portion 22 is viewed in the direction of part (a) of FIG. 4.

Next, the periphery of the electrical connecting portion 22 as viewed in the direction of the arrow B in FIG. 3 is shown in part (b) of FIG. 4. The direction of the arrow B in FIG. 3 is the direction from the upper side to the lower side with respect to the direction of gravity. In addition, the periphery of the electrical connecting portion 22 as viewed in the direction of the arrow C in FIG. 3 is shown in part (c) of FIG. 4. The direction of the arrow C is an oblique direction from the upper side to the lower side with respect to the direction of gravity. In the direction of the arrow B and the direction of the arrow C, the electrical connecting portion 22 is not seen, and the connector 22*a* extending toward the inside of the recording apparatus from the electrical connecting portion 22 is seen. The connector 22*a* extends from the electrical connecting portion 22 and has the function of wiring that enables the electrical connecting portion 22 to be electrically connected to the inside of the recording device. As a material for forming the connector 22*a*, copper alloy (gold plating) and the like are available.

A cross-section taken along line A-A' of part (b) of FIG. 4 is shown in part (d) of FIG. 4. As described above, the ink receiving tube 21 projects from the rear side surface of the hole 14*f* formed by the hole forming member 14*b*. In addition, the plurality of electrical connecting portions 22 are interposed between the walls 23*a*, 23*b*.

Next, FIG. 4(*e*) shows the periphery of the electrical connecting portion 22 of the mounting portion as viewed in the direction of the arrow D in FIG. 3. The direction of the arrow D in FIG. 3 is the direction from the front side to the back side when mounting the ink cartridge to the mounting portion. In addition, it is also the extending direction of the hole (hole 14*d* and hole 14*f*) formed by the hole forming member 14*a* and the hole forming member 14*b*. Furthermore, it is the y direction, the horizontal direction perpendicular to the direction of gravity. As viewed in the direction of arrow D, the ink receiving tube 21 is visible on the rear side of the hole 14*f* formed by the hole forming member 14*b*. In addition, the wall 23*a*, and the wall 23*b* as another wall arranged so as to partially overlap the wall 23*a* on the far side of the wall 23*a* are seen. Here, the hole forming member 14*a* is omitted, but when the hole forming member 14*a* is provided, the hole forming member 14*a* is seen in front of the hole forming member 14*b*. And, the ink receiving tube 21 is seen on the rear side of the hole formed by connecting the holes (the hole 14*d* and the hole 14*f*) formed by the hole forming member 14*a* and the hole forming member 14*b*. To the ink receiving tube 21, the ink cartridge is inserted from the front side to the rear side (y direction) along the inserting direction.

Parts (a) and (b) of FIG. 5 is a view of the periphery of the electric connecting portion 22 as viewed another angular direction. Part (a) of FIG. 5 shows the periphery of the electrical connecting portion 22 as viewed in the direction of the arrow E in FIG. 3. Part (b) of FIG. 5 shows the periphery of the electrical connecting portion 22 as viewed in the direction of the arrow F in FIG. 3. The arrow E direction and the arrow F direction obliquely extend from the lower side to the upper side in the gravy direction around the electric connecting portion 22. As described in part (a) of FIG. 4, a part of the electrical connecting portion 22 of the electrical connecting portion 22 is covered with the hole forming member 14*b* in the downward direction of the electrical connecting portion 22. In addition, in Parts (a) and (b) of FIG. 5, the four electrical connecting portions 22 are all in the form of connector pins. Each connector pin has a triangular shape. The connector pin is deformed so that the apex of the triangle contacts the pad electrode of the ink cartridge to be collapsed, by which an electrical contact point is provided. The electrical contact point can be thought of as the center of gravity position of the connector pin that is in contact with the pad electrode when the mounting is completed. In this electrical contact point, the pad electrode and the connector pin (electrical connecting portion) can be electrically connected. The pad electrode and the electrical connecting portion are electrically connected and electricity flows through the electrical contact point, so that the recording apparatus can detect the mounting of the ink cartridge, for example. Besides, for example, the recording apparatus reads the information (ink property information such as ink color information and/or ink remainder information) the ink cartridge provided in a chip or the like, and the recording apparatus can recognize the type of the mounted ink cartridge.

<Ink Cartridge>

An ink cartridge which can be mounted to the recording apparatus shown in FIG. 1 will be described.

FIG. 6 shows an outer appearance of the ink cartridge. Part (a) of FIG. 6 is an illustration showing the outer appearance of the ink cartridge 20.

Parts (b) to (d) of FIG. 6 are illustrations of the ink cartridge 20 shown in part (a) of FIG. 6 as viewed in another angle.

One ink cartridge 20 shown in FIG. 6 contains one color ink. However, a plurality of colors of ink may be stored separately in one ink cartridge 20, or the stored color inks may be supplied to different ink receiving tubes, respectively. In addition, as a set of the ink cartridges 20, a plurality of ink cartridges may store the same color ink.

As shown in FIG. 6, the ink cartridge 20 includes a cylindrical shaped casing indicated by reference numerals 20*a* to 20*c*. As described above, the ink cartridge 20 is constituted with the casing as a base member. As will be described hereafter, the shape of the casing is not limited to a circular cylindrical shape, and may be a polygonal cylindrical shape such as a triangular cylindrical shape or a quadrangular cylindrical shape. Or, the shape may be a cone, or may be a polygonal pyramid shape such as a triangular pyramid shape or a quadrangular pyramid shape.

The ink cartridge 20 (casing) includes at least a first portion 20*a*, a second portion 20*b*, and a third portion 20*c* as portions facing the outside of the ink cartridge 20. The portion on the side where the insertion portion 24 is provided is the first portion 20*a*. The portion opposite to the first portion 20*a* is the second portion 20*b*. And, the first portion 20*a* and the second portion 20*b* are connected by the third portion 20*c*. The third portion 20*c* is between the first portion 20*a* and the second portion 20*b*, and in FIG. 6, the third portion 20*c* is perpendicular to the first portion 20*a* and to the second portion 20*b.ing*. The first portion 20*a*, the second portion 20*b*, and the third portion 20*c* may be respective surfaces, as shown in FIG. 6. Or, at least one of the first portion 20*a*, the second portion 20*b*, and the third portion 20*c* may not be a surface. For example, when the ink cartridge 20 has a triangular pyramid shape, it is possible that the first portion 20*a* is a bottom surface of the triangular pyramid, the second portion 20*b* is the apex on the bottom surface of the triangular pyramid, and the third portion 20*c* is a side surface of the triangular pyramid. In such a case, the second portion 20*b* is an apex, not a surface.

The portion facing the outside of the ink cartridge 20 is the portion facing away from the central axis of the ink cartridge 20 (a axis extending through the center of gravity of the ink cartridge 20 and extending parallel to the longitudinal direction of the ink cartridge 20). For example, the side surface of the casing of the cylindrical ink cartridge 20 shown in FIG. 6. On the other hand, for example, the surface of the electrode unit 30 shown in FIG. 8 opposite to the side on which the electrode portion 32 is provided (more clearly, the back surface 31*b* of part (b) of FIG. 7) is exposed to an outside of the ink cartridge 20 (a gap below the electrode unit 30). However, since it faces in the direction approaching the central axis of the ink cartridge 20, it is not a portion facing the outside of the ink cartridge 20, but a portion facing the inside of the ink cartridge 20.

The first portion 20*a* of the ink cartridge 20 is provided with an insertion portion 24 through which the ink receiving tube 21 shown in FIG. 3 is inserted. Therefore, it can be said first portion 20*a* is a front portion of the ink cartridge 20. In FIG. 6, the first portion 20*a* is a surface. The insertion portion 24 may be provided with a seal member having an opening. When the seal member is provided, the ink receiving tube is inserted into the opening of the seal member of the insertion portion 24. It is preferable that a diameter of the insertion portion 24 (diameter measured in the direction perpendicular to the direction in which the ink receiving tube is inserted) is 2 mm or more and 5 mm or less. It is preferable that a diameter of the first portion 20*a* including the insertion portion 24 is 8 mm or more and 14 mm or less.

Ink is stored inside the casing of the ink cartridge 20. The ink stored in the ink cartridge 20 is supplied into the recording device through the ink receiving tube inserted into the insertion portion 24 (or the opening of the sealing member when there is a sealing member) and is used for recording. As described above, the insertion portion 24 is a portion for leading out the ink stored in the casing of the ink cartridge 20, and therefore, it can also be called an ink lead-out portion.

The casing of the ink cartridge 20 includes a large-diameter portion having a relatively larger diameter (than that of the small-diameter portion) and a small-diameter portion having a relatively smaller diameter (than that of the large-diameter portion). Here, the diameter is an equivalent circle diameter of the cross-section of the casing of the ink cartridge 20 taken along a plane perpendicular to the direction from the first portion 20*a* toward the second portion 20*b*. The casing of the ink cartridge 20 in FIG. 6 has a cylindrical shape, and has a circle diameter in a cross-section taken along a plane perpendicular to a height direction of the cylinder. The portion on the side where the insertion portion 24 is provided in the small diameter portion is the first portion 20*a*. The second portion 20*b* is provided in the large diameter portion. The third portion 20*c* connecting the first portion 20*a* and the second portion 20*b* with each other is a surface which extends between the large diameter portion and the small diameter portion and which has a step between the large diameter portion and the small diameter portion. The casing of the ink cartridge 20 may not have a large-diameter portion or a small-diameter portion, and may have an even diameter, in other words the third portion 20*c* may have a shape without a step. The casing of the ink cartridge 20 shown in FIG. 6 has a cylindrical shape, the first portion 20*a* and the second portion 20*b* are the bottom surfaces of the cylinder, and the third portion 20*c* is the side surface of the cylinder. As described in the foregoing, the casing of the ink cartridge 20 is not limited to a cylindrical shape. The first portion 20*a* and/or the second portion 20*b* may have a stepped shape.

It is preferable that the diameter of the large diameter portion of the casing of the ink cartridge 20 is 50 mm or more and 80 mm or less. It is preferable that the diameter of the small diameter portion of the casing of the ink cartridge 20 is 20 mm or more and 30 mm or less. The casing of the ink cartridge 20 may have different diameters depending on the amount and type of ink stored therein. For example, in the ink cartridge set, for large-capacity ink cartridges, the diameter of the large diameter portion is 70 mm or more and 80 mm or less (for example, 75 mm). And, for a small-capacity ink cartridge, the diameter of the large-diameter portion is 50 mm or more and 60 mm or less (for example, 55 mm). However, it is preferable that the diameters of the small diameter portions are the same among the ink cartridges from the standpoint of mounting to the main assembly of the recording apparatus. Therefore, for example, in both the large-capacity ink cartridge and the small-capacity ink cartridge, the diameter of the small-diameter portion is set to 20 mm or more and 30 mm or less (for example, 25 mm). As described above, in an ink cartridge set in which the amounts or types of ink stored are different, it is preferable that the diameter of the small-diameter portion is the same and the diameter of the large-diameter portion is different among the ink cartridges.

It is preferable that the length of the large-diameter portion of the casing of the ink cartridge 20 in the direction parallel to the direction from the first portion 20*a* to the second portion 20*b* is 190 mm or more and 220 mm or less. It is preferable that the length of the diameter portion of the casing of the ink cartridge measured in the direction parallel to the direction the first portion 20*a* to the second portion 20*b* is 20 mm or more and 30 mm or less. From the standpoint of mounting to the main assembly of the recording apparatus, the lengths of the large-diameter portion and the small-diameter portion of the casing of the ink cartridge 20 are the same, even if the amounts and types of stored inks are different from each other as in the above-described ink cartridge set. Here, in this specification, the direction from the first portion 20*a* of the ink cartridge 20 (the casing thereof) to the second portion 20*b* (the direction from the second portion 20*b* to the first portion 20*a*) is the direction in which the shortest line connecting the first portion 20*a* and the second portion 20*b* with each other extends. This direction is a direction along the longitudinal direction of the ink cartridge 20 (the casing thereof) in FIG. 6. In addition, this is a direction parallel to the longitudinal direction of the ink cartridge 20 (the casing thereof).

Next, the projection 25 and the ID projection 28 will be described. The projecting portion 25 and the ID projection 28 are provided on a third portion 20*c* of the casing of the ink cartridge 20.

In FIG. 6, the projecting portion 25 is provided in the small diameter portion of the third portion 20*c*, and projects from the periphery of the projecting portion 25 constituting the third portion 20*c*.

In FIG. 6, the projecting portion 25 is provided in the small diameter portion of the third portion 20*c*, and projects beyond the periphery of the projecting portion 25 constituting the third portion 20*c*. That is, the projecting portion 25 is the projecting portion in the third portion 20*c*. Here, the periphery of the projecting portion 25 is the side surface (circumferential surface portion) of the cylinder, and the projecting portion 25 projects beyond the side surface of the cylinder.

An electrode unit 30 is mounted to the projection 25 so as to be rotatable in a horizontal plane (on an x-y plane) and movable in the vertical direction (z direction). Part (a) of FIG. 7 is a perspective view of the electrode unit 30. As shown in part (a) of FIG. 7, the electrode unit 30 includes a base member 31 and a chip-shaped electrode portion 32 including a memory element which stores ink color information and/or remaining amount information. The electrode portion 32 has a plurality of pad electrodes 33 (pad electrodes 33*a*, 33*b*, 33*c*, 33*d*) which are contactable contacts with the electrical connecting portions 22 of the recording apparatus (mounting part) and to be electrically connected to the electrical connecting portion 22. Here, the pad electrode 33 and the electrode portion 32 including the chip may be provided at positions separated from each other, and in such a case, it will suffice if they are electrically connected with each other by wiring or the like. The electrode portion 32 is provided in the third portion 20*c* of the casing of the ink cartridge. The plurality of pad electrodes 33 provided in the electrode portion 32 are also provided in the third portion 20*c*. As will be described hereafter, the plurality of pad electrodes 33 are mounted to the casing, and are rotatable relative to the casing. In addition, as will be understood from parts (a) of FIG. 6 and FIG. 7, in the ink cartridge 20, it is preferable that the electrode portion 32 and the pad electrode 33 are located at the third portion 20*c* closer to the first portion 20*a* than the second portion 20*b*. With this arrangement, the mountability is further improved.

It is preferable that the plurality of pad electrodes 33 includes four or more pad electrodes. In the example shown in part (a) of FIG. 7, there are four pad electrodes which the ink cartridge is provided with (two for the power line for accessing information stored in the memory element of the electrode portion 32, two for the information line). As described above, more preferably, the ink cartridge has four pad electrodes 33. In more detail, one is a reference terminal on the circuit, which is a pad electrode for ground, and which is basically always at zero potential. In addition, there is a pad electrode for the clock signal which produces pulses at a certain frequency and serves as the minimum unit of data transmission. Furthermore, there are a power supply pad electrode which has a positive potential by the power supply for operating the IC and so on, and a data signal pad electrode which operates the circuit by sending 0/1 signals according to the data. Here, in the pad electrodes shown in part (a) of FIG. 7, the pad electrode 33*a* is for the data signal, the pad electrode 33*b* is for the power supply, the pad electrode 33*c* is for the clock signal, and the pad electrode 33*d* is for the electrical grounding. It is preferable to make the pad electrode 33*d* for ground larger than other pad electrodes. This is because it is difficult to stabilize the operation without first connecting the ground pad electrode and keeping the reference potential constant, and therefore, this is to make the connection stable.

The base member 31 and the electrode portion 32 may be integrally formed by insert molding or the like, or the electrode portion 32 may be fixed to the base member 31 by clamping or the like. Here, if the electrode unit 30 including the pad electrode is rotatable relative to the casing, the projection 25 is not necessarily provided. In addition, even when the projection 25 is provided, the electrode unit 30 may be provided at a place other than the projection 25. However, for stable mounting, it is preferable that the projection 25 is provided, and the electrode unit 30 is provided on the projection 25.

Part (b) of FIG. 7 is an illustration of the electrode unit 30 shown in part (a) of FIG. 7 as viewed from below (in the arrow direction of part (a) of FIG. 7). As shown in part (a) of FIG. 7, the electrode portion 32 is provided on the roof surface 31*a* side of the base member 31. The roof surface 31*a* is a portion facing the outside of the ink cartridge 20. And, since the roof surface 31*a* is a part of the portion which connects the first portion 20*a* and the second portion 20*b* with each other, it is a part of the third portion 20*c*. Therefore, it can be said electrode portion 32 and the pad electrode 33 provided on the roof surface 31*a* are provided on the third portion 20*c* of the casing. The electrode portion 32 may be constituted only by the pad electrode 33. In this case, the pad electrode 33 is provided directly on the roof surface 31*a* of the projection 25.

On the back surface 31*b* opposite from the roof surface 31*a* of the electrode unit 30, a rotation restricting portion 34 for restricting portion of the rotation of the electrode unit 30 is provided. The rotation restricting portion 34 projects downward in the vertical direction (−z direction in part (a) of FIG. 6). As described in the foregoing, the back surface 31*b* is not a surface facing the outside of the ink cartridge 20, but a surface facing the inside of the ink cartridge 20.

As will be described in detail hereinafter, the base member 31 is provided with a side wall 31*c* which contacts the wall 23*b* of the mounting portion, and a side wall 31*d* which is continuous from the side wall 31*c* and connected to the side wall 31*c*. An urging member 36 is mounted to the side wall 31*d*. In addition, the base member 31 is provided with a shaft hole 35 for passing through a shaft 250 of the casing of the ink cartridge 20.

Part (a) of FIG. 8 is an illustration of a state before the electrode unit 30 including a plurality of pad electrodes is mounted in the ink cartridge 20. Here, as shown in part (a) of FIG. 8, an example in which the shaft 250 and a cover member 300 are used to fix the electrode unit 30 will be described. The shaft 250 which projects from the projection roof surface 251 is provided on the projection roof surface 251 of the projection 25 which is a portion of the casing. The shaft hole 35 of the base member 31 of the electrode unit 30 is fitted around the shaft 250. Thereafter, a connecting surface 300*a* of the cover member 300 is connected to the projecting portion roof surface 251 of the projecting portion 25 by welding or the like so that the shaft hole 35 does not disengage from the end of the shaft 250. At this time, the outer diameter of the shaft 250 is made smaller than the inner diameter of the shaft hole 35. By doing so, the electrode unit 30 can rotate on a horizontal plane (on the x-y plane) relative to the casing, with the shaft 250 (the shaft hole 35) as the rotation center (rotation axis). In this manner, the electrode unit 30 is mounted to the projecting portion 25 of the ink cartridge 20. That is, the plurality of pad electrodes 33 are mounted to the casing of the ink cartridge 20. When the electrode unit 30 is rotated relative to the casing, the electrode portion 32 and the plurality of pad electrodes 33 of the electrode unit 30 are rotated relative to the casing on the casing.

A view of the neighborhood of the base member 31 in the x direction of part (b) of FIG. 8 is shown in part (c) of FIG. 8. As shown in part (c) of FIG. 8, a gap larger than the thickness of the base member 31 (and the electrode unit 30) is provided between the roof surface 31*a* of the base member 31 and the bottom surface 300*b* of the cover member 300. In this manner, the electrode unit 30 can move in the vertical direction (z direction) by the amount of the gap.

It is preferable that the electrode unit 30 and the pad electrode are provided at least partially between the casing and a gap. In part (c) of FIG. 8, a gap 37 is provided between the electrode unit 30 and the third portion 20*c* of the casing. The gap 37 is provided below the electrode unit 30 and the pad electrode. The lower portion of the electrode unit 30 and the pad electrode is Based on the direction from the electrode unit 30 and the pad electrode towards the center of gravity in a cross-sectional plane along a direction perpendicular to the direction toward the second portion 20*b* from the first portion 20*a* of the ink cartridge 20. Into the gap 37, a support member (not shown in part (c) of FIG. 8) of the mounting portion is inserted. By this, the electrode unit 30 and the pad electrode on the gap 37 are supported by the support member at the bottom thereof, and therefore, the downward movement thereof can be restricted, and the positional relationship between the electrical connecting portion 22 and the pad electrode can be stabilized.

In addition to stabilizing the positional relationship between the electrical connecting portion 22 and the pad electrode, the gap 37 can also perform another function. For example, heat may be generated at the electrical contact between the electrical connecting portion 22 and the pad electrode. It is preferable that this heat is prevented from affecting the ink receiving tube 21 and the insertion portion 24 as much as possible to stabilize the ink supply. The gap 37 can act as a portion promoting heat radiation. That is, the heat generated at the electrical contacts can be released from the gap 37 to the outside.

On the other hand, when the ink cartridge 20 is formed of a highly heat-conductive member, the gap 37 functions as a heat insulating member, making it difficult to transfer the heat generated at the electrical contact to the ink receiving tube 21 and the insertion portion 24.

In addition, the gap 37 may have a shape in which the lower side of the gap 37 is opened. That is, the structure may be such that there is a gap below the pad electrode, and no component such as a casing of the ink cartridge exists below the gap.

The gap 37 may be provided in the ink cartridge side in a state that the ink cartridge is mounted to the mounting portion. For example, even if the gap 37 is filled with a member before the ink cartridge is mounted to the mounting portion, it will suffice if such a member is retracted during the mounting process, and the gap is provided in the mounted state. In addition, even if the support member which is a member other than the ink cartridge is inserted into the gap so as to fill the gap, in such a manner, the ink cartridge is deemed to have the gap 37. The gap 37 can also be called a recess of the ink cartridge.

Next, the ID projection 28 will be described. The ID projection 28 is provided on the large diameter portion of the third portion 20*c*. The ID projection 28 projects beyond the outer periphery of the ID projection 28 in the third portion 20*c*. The periphery of the ID projection 28 is the side surface of the cylindrical ink cartridge casing, and the ID projection 28 projects from this side surface.

It is preferable that the portion of the ID projection 28 on the first portion 20*a* side is located at a position 40 mm or more and 50 mm or less from the first portion 20*a* in a distance in a direction parallel to the direction from the first portion 20*a* of the ink cartridge 20 toward the second portion 20*b*. In addition, further preferably, it is disposed at a position of 41 mm or more and 45 mm or less from the first portion 20*a*. On the other hand, it is preferable that the portion on the second portion 20*b* side of the ID projection 28 is located at a position of 50 mm or more and 60 mm or less from the first portion 20*a* in a distance in a direction parallel to the direction from the first portion 20*a* of the ink cartridge 20 toward the second portion 20*b*.

In addition, it is preferable that the height of the ID projection 28 is 3 mm or more and 10 mm or less. The height of the ID projection 28 is further preferably 4 mm or more and 5 mm or less. Here, the height of the ID projection 28 is the height of the ID projection 28 projecting from the periphery, in the vertical direction, from the periphery thereof, and is a length of a portion indicated by "B" in part (d) of FIG. 6. If there is a portion with a different height in the ID projection portion 28, the average value at 100 points randomly distributed in the ID projection portion 28 is used.

Examples of the material forming the projection 25 and the base member 31 include PE (polyethylene) and PP (polypropylene). Examples of the material for forming the electrode portion 32 include glass epoxy and polyimide flexible printed boards. Examples of the material for forming the pad electrodes 33*a* to 33*d* include Ni and Au. Examples of the material forming the ID projection 28 include PE (polyethylene) and PP (polypropylene).

It is preferable that the casing of the ink cartridge 20 is formed in a two-layer structure including an outer layer and an inner layer. The outer layer is the outside layer visible in part (a) of FIG. 6 and is preferably made of a highly rigid material. On the other hand, the inner layer is the inside layer and is preferably made of a flexible material. Thus, it is preferable that the outer layer is more rigid than the inner layer. It is preferable that The outer and inner layers are made of separate materials, and separable from each other. The inner layer has a flexible bag shape, for example, and the ink is stored inside (inside) the inner layer, and the outer layer covers the outside of the inner layer.

<Ink Cartridge Mounting Operation>

The ink cartridge can be mounted on the mounting portion of the recording apparatus. The mounting operation when mounting the ink cartridge to the mounting portion of the recording apparatus will be described.

FIG. 9 is an illustration of a process of mounting the ink cartridge in the mounting portion. In FIG. 9, a portion of the mounting portion 14 of the recording apparatus is schematically indicated by dotted lines from the standpoint of easy illustration.

Before reaching the state shown in part (a) of FIG. 9, the portion of the ink cartridge 20 on the first portion 20*a* side is put into a hole of a hole forming member. And, the positions of the ink cartridge 20 and the mounting portion 14 are aligned by the ID projection 28 of the ink cartridge 20 and the ID recess portion 14*c* of the mounting portion 14. When an ink cartridge other than the ink cartridge which should be inserted is going to be inserted into the hole of the hole forming member, the ID projection 28 and the ID recess portion 14*c* do not align with each other, and therefore, the insertion is prevented. For example, when an ink cartridge for storing magenta is going to be inserted into the hole in which the cyan ink cartridge is to be inserted, the shapes of the ID projection 28 and the ID recess portion 14*c* do not match with each other, and therefore, the ink cartridge cannot be inserted into the hole. On the other hand, for example, when an ink cartridge for storing cyan is going to be inserted into a hole in which a cyan ink cartridge is to be inserted, the shapes of the ID projection 28 and the ID recess portion 14*c* match with each other, and the ink cartridge can be inserted into the hole.

When the shape of the ID projection 28 matches the shape of the ID recess portion 14*c*, the ink cartridge 20 is inserted into the hole of the mounting portion 14 along the inserting direction with the first portion 20*a* as the leading side. Part (a) of FIG. 9 is an illustration showing a stage in the middle of the insertion process. It can be said inserting direction of the ink cartridge 20 is the direction in which the first portion 20*a* is the leading side, and also the direction in which the insertion portion 24 is the leading side. In the following, the inserting direction with the first portion 20*a* of the ink cartridge 20 as the leading side is expressed simply as "the inserting direction of the ink cartridge (20)". In part (a) of FIG. 9, the inserting direction of the ink cartridge 20 is indicated by an arrow. The inserting direction of the ink cartridge 20 is the same as the direction from the second portion 20*b* of the ink cartridge 20 toward the first portion 20*a* thereof (and the longitudinal direction of the ink cartridge 20).

As shown in part (a) of FIG. 9, the ID recess portion 14*c* of the mounting portion 14 extends along the extending direction of the hole formed by the hole forming member, and after the alignment established before insertion, the ink cartridge 20 is inserted while the ID projection 28 is kept aligned with the ID recess portion 14*c*.

Part (b) of FIG. 9 shows a state at a point of time when the ink cartridge 20 is further inserted and the electrode unit 30 reaches the wall 23*b* (not shown, FIG. 3) of the mounting portion of the main assembly. Here, from the start of insertion to just before the electrode unit 30 comes into contact with the wall 23*b*, the force for rotating the electrode unit 30 is not particularly applied to the electrode unit 30. Therefore, the electrode unit 30 does not rotate relative to the casing of the ink cartridge 20. That is, from the start of insertion, the electrode unit 30 advances in the same direction as the inserting direction of the ink cartridge 20 (the casing of the ink cartridge 20) and reaches the wall 23*b*. When the electrode unit 30 reaches the wall 23*b*, the electrode unit 30 comes into contact with the wall 23*b*, receives a force from the wall 23*b*, and starts to rotate relative to the casing thereon. The electrode unit 30 may rotate before it contacts the wall 23*b*. However, in order to perform more stable mounting, it is preferable that the electrode unit 30 does not rotate from the start of insertion of the ink cartridge 20 to the position shown in part (b) of FIG. 9, that is, from the start of insertion until the electrode unit 30 contacts the wall 23*b*.

Part (c) of FIG. 9 shows a state in which the ink cartridge is inserted, the electrode unit 30 is further rotated relative to the casing on the casing, and the mounting is finally completed. When the mounting is completed, the electrode unit 30 is already rotated relative to the ink cartridge 20 in a horizontal plane (x-y plane) and already changes the orientation thereof. And, each of the pad electrodes 33*a* to 33*d* of the electrode portion 32 is in a state the it can be electrically connected to the electrical connecting portion 22 on the main assembly side (for example, in a contact state).

When the mounting shown in Part (c) of FIG. 9 is completed, the preferred position of the leading end of the ink receiving tube 21 will be explained. That is, it is preferable that the position is 10 mm or more and 20 mm or less from the first portion 20*a* of the ink cartridge 20 in a distance parallel to the direction from the first portion 20*a* of the ink cartridge 20 toward the second portion 20*b*. Further preferably, it is 11 mm or more and 15 mm or less from the first portion 20*a*. Here, in FIG. 8, the direction from the first portion 20*a* toward the second portion 20*b* is the same as the longitudinal direction and the inserting direction of the ink cartridge 20.

Referring to FIG. 10 and FIG. 11, the rotation of the electrode unit 30 during the mounting operation of the ink cartridge 20 shown in parts (b) and (c) of FIG. 9 will be described in detail. FIG. 10 is an enlarged view of the periphery of the electrical connecting portion 22 in FIG. 9 as viewed from the direction of the arrow shown in part (b) of FIG. 9. Here, from the standpoint of better illustration, the mounting portion 14 is shown only by the hole forming member 14*b*. Parts (a) to (c) in FIG. 11 show a cross-sectional views around the electrical connecting portion 22 (cross-sectional views taken along a line 9A-9A in part (a) of FIG. 10), in parts (a) to (c) in FIG. 10. Here, the inserting direction of the ink cartridge 20 is the +y direction in each Figure.

Part (a) in FIG. 10 and part (a) in FIG. 11 show the state when the ink cartridge 20 is inserted and the electrode unit 30 reaches the wall 23*b* (the state in part (b) in FIG. 9). At this point of time, as shown in part (a) of FIG. 11, the side wall 31*c* of the base member 31 of the electrode unit 30 is in contact with the wall 23*b* at a point 11A. When the side wall 31*c* has a rounded shape, the side wall 31*c* and the wall 23*b* are in contact with each other only at the point 11A. The wall 23*b* extends so as to incline toward the +y direction as it advances in the +x direction in the Figure. Therefore, when the ink cartridge 20 is further advanced in the inserting direction (+y direction) while the side wall 31*c* of the base member 31 is in contact with the wall 23*b* at the point 11A, the side wall 31*c* receives the force including a component in the +x direction from the wall 23*b* at the point 11A. By this force, the base member 31, that is, the electrode unit 30 rotates about the shaft 250 in the direction of the arrow shown in part (b) of FIG. 11.

As long as the side wall 31*c* of the base member 31 is in contact with the wall 23*c*, the base member 31 (electrode unit 30) continues to rotate as the ink cartridge 20 is inserted. Eventually, when the ink cartridge 20 is inserted and the electrode unit 30 is rotated and the contact portion with the wall 23*b* reaches the side wall 31*d* of the base member 31, the urging member 36 mounted on the side wall 31*d* presses against the wall 23*b*. By this, the rotation of the electrode unit 30 is further promoted. Thereafter, by proceeding with the insertion of the ink cartridge in the inserting direction, as shown in part (c) of FIG. 11, the electrical connecting portion 22 and the pad electrode 33 come into contact with each other so that electrical connection becomes possible, and mounting is completed. As will be understood by comparing part (a) in FIG. 11 and part (c) in FIG. 11, the electrode unit 30 rotates on the x-y plane relative to the ink cartridge to change the orientation thereof after insertion of the ink cartridge, relative to the orientation thereof before the insertion.

FIG. 12 shows a view in which, portion of the electrode portion 32 and the base member 31 is made transparent (dotted line part) in the state of part (c) of FIG. 11, so that the rotation restricting portion 34 provided on the back surface 31*b* of the base member 31 is made visible. As shown in FIG. 12, in the mounting completion state, the rotation restricting portion 34 is in contact with the rotation restricting wall 140 of the hole forming member 14*b*. Therefore, the rotation of the electrode unit 30 is stopped, and the excessive rotation is suppressed, so that good mounting operation is accomplished.

FIG. 13 is a view of the behavior of rotation of the electrode unit 30 as viewed from the first portion 20*a* side of the ink cartridge 20. Part (a) of FIG. 13 shows the initial state of rotation of the electrode unit 30, and Part (b) of FIG. 13 shows the state of the end of rotation of the electrode unit 30, that is, a state when the mounting of the ink cartridge 20 is completed. As in part (a) of FIG. 13, the electrode unit 30 is at a position spaced apart from the electrical connecting portion 22 on the main assembly side in the z direction at the initial stage of rotation. Thereafter, as the electrode unit 30 rotates, the rotation restricting portion 34 of the base member 31 ascends in the z direction as if it climbs on the second portion 20*c* while contacting the outer periphery of the second portion 20*c* of the ink cartridge 20. Finally, the pad electrodes of the electrode unit 30 reach a position where it can come into contact with the electrical connecting portion 22 on the main assembly side. With such a structure, it is less likely for the electrode unit 30 and the electrical connecting portion 22 on the main assembly side to come into contact with each other from the beginning of the rotation of the electrode unit 30, and therefore, a damage to the electrical connecting portion 22 and the latch or resistance against the rotation of the electrode unit 30 is suppressed. Here, as shown in FIG. 9, it is preferable that the ID projection 28 is located inside the ID recess portion 14*c* from the beginning of rotation of the electrode unit 30 to the end of rotation (completed mounting). With this structure as described above, the rotation of the ink cartridge 20 itself is suppressed, and only the electrode unit 30 is rotated relative to the casing of the ink cartridge 20, and therefore, a more reliable electrical connection is accomplished.

FIG. 14 shows a trace of the pad electrodes 33*a* to 33*d* from the start of rotation of the electrode unit 30 described above to the end of the rotation. As the electrode unit rotates, the pad electrode provided in the electrode unit also rotates in the same manner. In FIG. 14, the pad electrodes 33*ai* to 33*di* indicate the positions thereof at the initial stage of the rotation. In addition, the pad electrodes 33*a* f to 33*d* f are shown when the rotation is completed, that is, this is the position of each pad electrode when mounting is completed. The inserting direction of the ink cartridge 20 is the +y direction. As shown in the Figure all the pad electrodes 33*a* to 33*d* move in a direction different from the inserting direction (+y direction) of the ink cartridge 20 (a direction inclined from the +y direction to the +x direction), and come into contact with the electrical connecting portion 22 on the main assembly side. As described above, when the ink cartridge 20 is mounted, the pad electrode 33 is rotated by the rotation of the electrode unit, and the pad electrode 33 is moved in a direction different from the inserting direction of the ink cartridge 20. For this reason, even if the ink cartridge 20 is strongly inserted in the inserting direction, when the pad electrode 33 comes into contact with the electrical connecting portion 22 on the main assembly side, the impact due to the insertion is less likely to be received. Therefore, the impact received by the pad electrode 33 and the electrical connecting portion 22 can be reduced.

In contrast, a case will be considered in which the ink cartridge 20 is inserted in the inserting direction, the pad electrode 33 does not rotate but moves only in the same direction as the inserting direction of the ink cartridge 20, and the pad electrode 33 is electrically connected to the electrical connecting portion 22. For example, this is such a case that the electrode unit and the pad electrode 33 are fixed to the ink cartridge 20 and do not rotate, and the ink cartridge 20 itself is inserted only linearly in the inserting direction without rotation. In this case, the impact due to the insertion of the ink cartridge 20 in the inserting direction tends to be directly transmitted to the pad electrode 33 in contact with the electrical connecting portion 22. The insertion speed of the ink cartridge 20 in the inserting direction tends to be high. As described above, if the impact due to insertion in the inserting direction is easily transmitted to the pad electrode 33 and the electrical connecting portion 22 when the pad electrode 33 and the electrical connecting portion 22 are connected, the contact between the pad electrode 33 and the electrical connecting portion 22 may not be good. As a result, deformation or the like of the pad electrode 33 or the electrical connecting portion 22 may occur.

As long as it is intended only to make different the inserting direction of the ink cartridge 20 and the moving direction of the pad electrode 33 from each other, there is no need to rotate the electrode unit. For example, the electrode unit can also be arranged so that it can move freely within a certain range without using a rotating shaft in the casing of the ink cartridge 20. However, as in the present invention, by rotating the electrode unit, with use of the rotation axis, relative to the casing of the ink cartridge 20, the rotation of the pad electrode 33 is stabilized, in the deformation of the electrical connection unit 22 can be suppressed more stably.

In addition, the pad electrode 33 may not be rotated at any position in the case of the ink cartridge, and by rotating the pad electrode 33 relative to the casing on the casing, the deformations of the pad electrode and the electrical connecting portion can be suppressed. Furthermore, From the standpoint of suppressing deformation of the pad electrode and the electrical connecting portion, it is preferable that a plurality of pad electrodes are provided on the chip-shaped electrode portion, and the electrode portion and the pad electrode are rotated without changing the facing direction of the surface of the electrode portion on which the pad electrode is provided.

Any method may be used to remove the ink cartridge from the mounting portion, but it is preferable to operate in the reverse manner relative to the above-described mounting operation. By doing so, it is preferable that the pad electrode 33 rotates in the opposite (opposite) direction to that of the rotation described above, and finally returns to the original position on the casing.

Embodiment 2

Embodiment 2 will be described with a focus on the points different from Embodiment 1. In the following description of embodiments, the characteristic portion of each embodiment will be focused, and the description of the common portion may be omitted for the sake of simplicity. In Embodiment 2, the rotation movement of the electrode unit is different from that in Embodiment 1.

FIG. 15 shows the structure of the ink cartridge 20 in Embodiment 2. The ink cartridge 20 has an electrode unit 40 on the projecting portion 25 of the casing. The electrode unit 40 can rotate on the x-y plane relative to the casing of the ink cartridge 20 and can move in the z direction.

FIG. 16 shows a perspective view of the electrode unit 40. As shown in FIG. 16, the electrode unit 40 includes a base member 41 and an electrode portion 42. The electrode portion 42 includes a plurality of pad electrodes 43 (pad electrodes 43*a*, 43*b*, 43*c*) which is capable of coming into contact with the electrical connecting portion 22 of the recording apparatus (mounting part) and is electrically connectable to the electrical connecting portion 22. 43*d*). As compared with the electrode unit 30 shown in FIG. 7, the shape of the base member and the arrangement of the electrode portion and the pad electrode are different.

The base member 41 will be described in detail hereinafter, but there are a side wall 41*c* (broken line portion) in contact with the wall 23*b* and a side wall 41*d* connected to the side wall 41*c* continuously from the side wall 41*c*. The side wall 41*c* has a rounded shape throughout, and the side wall 41*d* has a flat shape. In addition, the urging member employed in Embodiment 1 is not provided. The urging member 36 is for promoting the rotation, but by making the entire portion (side wall 41*c*) that becomes the contact portion with the wall 23*b* of the base member 41 into a rounded shape, the base member 41 can be continuously rotated without using an urging member. The pad electrode 43 is provided along the side wall 41*c* on the side of the side wall 41*c* in the electrode unit 40. In addition, the shaft hole 45 is provided at a position more remote than the pad electrode 43 with respect to the side wall 41*c*.

The position of the center of gravity of each of the plurality of pad electrodes 43*a* to 43*d* in FIGS. 15 and 16 will be described. The positions of the centers of gravity of these electrodes are arranged on the roof surface 41*a* of the base member 41 along a direction inclined from the direction from the second portion 20*b* of the ink cartridge 20 toward the first portion 20*a*, toward the direction perpendicular to this direction. The direction from the second portion 20*b* toward the first portion 20*a* is the +y direction in FIG. 15. In addition, the orthogonal direction is the x direction in FIG. 15. It is preferable that The positions of the centers of gravity of the electrodes are arranged in a direction inclined, in the direction perpendicular to this direction, in the range from 30° to 50° from the direction from the first portion 20*a* to the second portion 20*b* of the ink cartridge 20.

Referring to FIG. 17 and FIG. 18 the rotation of the electrode unit 40 during the mounting operation of the ink cartridge 20 of this embodiment, will be described in detail. FIG. 17 is a view illustrating the periphery of the electrical connecting portion 22. Here, from the standpoint of better illustration, only the hole forming member 14*b* is shown for the mounting portion 14. Parts (a) to (c) of FIG. 18 are cross-sectional views around the electrical connecting portion 22 of taken along a line 17*a*-17*a* in parts (a) to (c) of FIG. 17). Here, the inserting direction of the ink cartridge 20 is the +y direction in each Figure. Part (b) of FIG. 17 and Part (b) of FIG. 18 show the state in the middle of the rotation process of the electrode unit 40, part (c) of FIG. 17 and Part (c) of FIG. 18 show the state of the time when the mounting operation is completed.

The side wall 41*c* of the base member 41 of the electrode unit 40 has a rounded shape. As shown in part (a) of FIG. 18 the side wall 41*c* of the base member 41 is in contact with the wall 23*b* at the point 18A. The wall 23*b* extends so as to incline in the +y direction as it advances in the +x direction in the Figure. Therefore, when the ink cartridge 20 is further advanced in the inserting direction (+y direction) with the side wall 41*c* of the base member 41 in contact with the wall 23*b* at the point 18A, the side wall 41*c* receives a force having a component in the +x direction from the wall 23*b* at the point 18A. By this force, the base member 41, that is, the electrode unit 40 is rotated in the direction of an arrow shown in Part (b) of FIG. 18 about the shaft 250.

Until the mounting is completed, the wall 23*b* and the side wall 41*c* of the base member 41 are kept in contact with each other at a certain point (point 18A). For this reason, as the ink cartridge 20 is inserted, the base member 41 (electrode unit 40) continues to rotate. Eventually, when the contact portion (the point of contact) with the wall 23*b* approaches to the side wall 41*d* of the base member 41, the base member 41 is difficult to rotate, even if the ink cartridge 20 is inserted, because the side wall 41*d* has a flat shape there. At this point of time, the ink cartridge 20 is completely mounting. When the mounting is completed, the pad electrode 43 is connected to the electrical connecting portion 22 and is in an electrically connectable state. Here, instead of providing the side wall 41*d*, a rotation restricting portion 140 may be provided on the back surface of the base member 41 on the main assembly side as in Embodiment 1, so that the rotation is stopped by contacting the rotation restricting wall 140.

FIG. 19 shows the trace of the pad electrodes 43*a* to 43*d* from the start to the end of the rotation of the electrode unit described above. As the electrode unit rotates, the pad electrode provided in the electrode unit also rotates in the same manner. Part (a) of FIG. 19 shows the trace of the pad electrode 43*a*, and Part (b) of FIG. 19, part (c) of FIG. 19, and Part (d) of Figure Shows the trace of the pad electrodes 43*b*, 43*c*, 43*d*. In the Figures, white arrows indicate the inserting direction of the ink cartridge 20. In FIG. 14, the positions of the pad electrodes 43*ai* to 43*di* are the initial positions of the pad electrodes, respectively. In addition, the pad electrodes 43*a* f to 43*d* f are the respective positions of the pad electrodes when the rotation is completed, that is, when mounting operation is completed.

As shown in Figure when the ink cartridge 20 is mounted, the pad electrodes 43*a* to 43*d* are rotated by the rotation of the electrode unit, and the pad electrodes 43 are moved in a direction different from the inserting direction of the ink cartridge 20. Furthermore, in Embodiment 2, the electrical connecting portion 22 is connected while moving including movement component in the direction opposite to the inserting direction of the ink cartridge 20. The rotation angle of the electrode unit and the pad electrode is 90 degrees or less in Embodiment 1, but it exceeds 90 degrees in Embodiment 2. For this reason, even if the ink cartridge 20 is strongly inserted in the inserting direction, the impact due to the insertion is less likely received, when the pad electrode 33 comes into contact with the electrical connecting portion 22 on the main assembly side. Therefore, the impact received by the pad electrode 33 and the electrical connecting portion 22 can be reduced.

Embodiment 3

In Embodiment 1 and Embodiment 2, the member which can be mounted to (mountable to) the mounting portion is the ink cartridge which stores ink. However, the present invention is not limited to this, and the member may be the one that does not contain ink. For example, the ink cartridge shown in Embodiment 1 or Embodiment 2 is a member that does not contain ink. And, this member is mounted on the mounting portion by rotating the electrode unit or the pad electrode with respect to the casing, in the same manner as described in Embodiment 1 or Embodiment 2. Thereafter, a member which stores ink or a tube which supplies ink can be mounted to the member mounted on the mounting portion.

Embodiment 4

Up to this point, an example has been shown in which the rotation of the electrode unit and the pad relative to the casing is performed using contact with the wall of the mounting portion on the main assembly side. The method of rotating the electrode unit or pad electrode relative to the casing is not limited to this example. The casing may have a power source that generates rotational energy so that the electrode unit and pad electrode can automatically rotate without contacting the wall of the mounting portion on the main unit side. Or, a member connected to the electrode unit may be provided in the casing, and the user may operate the member to rotate the electrode unit and the pad electrode relative to the casing.

INDUSTRIAL APPLICABILITY

According to the present invention, there is provided a member usable with an ink jet recording apparatus including a plurality of pad electrodes and a casing, wherein the plurality of pad electrodes are mounted to the casing and are rotatable relative to the casing on the casing.

While the present invention has been described with reference to exemplary embodiments, it is to be understood that the invention is not limited to the disclosed exemplary embodiments. The scope of the following claims is to be accorded the broadest interpretation so as to encompass all such modifications. And equivalent structures and functions.

This application claims the benefit of Japanese Patent Application No. 2018-184603 filed on Sep. 28, 2018, which is hereby incorporated by reference herein in its entirety.

The invention claimed is:

1. An ink cartridge comprising a casing to which an electrode unit, including a plurality of pad electrodes, is mounted and configured to store ink therein, wherein the electrode unit is rotatable relative to the casing in a plane provided with the plurality of pad electrodes.

2. An ink cartridge according to claim 1, further comprising a first portion, a second portion opposite to the first portion, a third portion connecting said first portion and said second portion with each other, as portions facing an outside of the ink cartridge, wherein the electrode unit is provided on the third portion.

3. An ink cartridge according to claim 1, wherein the electrode unit moves in a direction perpendicular to the plane by rotating the electrode unit relative to the casing.

4. An ink cartridge according to claim 1, wherein a gap is provided below the electrode unit, and between the casing and the electrode unit.

5. A recording apparatus comprising the ink cartridge according to claim 1.

6. An ink cartridge according to claim 1, wherein the electrode unit is provided with a shaft hole, a shaft of the casing passes through the shaft hole, and the electrode unit rotates relative to the casing about the shaft as a rotational axis.

7. An ink cartridge mountable to a mounting portion including an ink receiving tube and a plurality of electrical connecting portions, said ink cartridge comprising: a casing to which an electrode unit, including a plurality of pad electrodes electrically connectable to the plurality of electrical connecting portions, is mounted and configured to store ink, wherein the electrode unit is rotatable relative to the casing in a plane provided with the plurality of pad electrodes.

8. An ink cartridge according to claim 7, further comprising a first portion which is a leading portion when the ink cartridge is mounted on the mounting portion along a mounting direction, a second portion on the opposite side of the first portion, and a third portion connecting the first portion and the second portion with each other, as portions facing an outside of the ink cartridge, wherein the electrode unit is provided on the third portion.

9. An ink cartridge according to claim 8, wherein the plurality of pad electrodes are movable in a direction different from the inserting direction by the rotation relative to the casing.

10. An ink cartridge according to claim 7, wherein the plurality of pad electrodes are electrically connected to the electrical connecting portions by rotating the electrode unit relative to the casing.

11. An ink cartridge according to claim 7, wherein a gap is provided below the electrode unit, and between the casing and the electrode unit.

12. An ink cartridge according to claim 7, wherein the electrode unit is provided with a shaft hole, a shaft of the casing passes through the shaft hole, and the electrode unit rotates relative to the casing about the shaft as a rotational axis.

13. An ink cartridge according to claim 7, wherein a rotational axis of the electrode unit is substantially perpendicular to the mounting direction of the ink cartridge.

* * * * *